US006210245B1

(12) United States Patent
Sando et al.

(10) Patent No.: US 6,210,245 B1
(45) Date of Patent: Apr. 3, 2001

(54) METHOD FOR PRODUCING ELECTRON SOURCE HAVING ELECTRON EMITTING PORTIONS, AND APPARATUS FOR PRODUCING ELECTRON SOURCE

(75) Inventors: Kazuhiro Sando, Atsugi; Mitsutoshi Hasegawa, Yokohama; Seiji Mishima, Zama; Kazuya Shigeoka, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/074,697

(22) Filed: May 8, 1998

(30) Foreign Application Priority Data

May 9, 1997 (JP) ..... 9-134466
May 6, 1998 (JP) ..... 10-137415

(51) Int. Cl.[7] ..... H01J 9/02
(52) U.S. Cl. ..... 445/6; 427/78; 445/24
(58) Field of Search ..... 445/6, 24, 51, 445/27; 427/78

(56) References Cited

U.S. PATENT DOCUMENTS 6,017,259 * 1/2000 Motoi et al. ..... 445/51
6,060,113 5/2000 Banno et al. ..... 427/78

FOREIGN PATENT DOCUMENTS 2-056822 2/1990 (JP) .
8-171850 7/1996 (JP) .
9-069334 3/1997 (JP) .

OTHER PUBLICATIONS

Araki, et al., "Electroforming and Electron Emission of Carbon Thin Films," *J. Vacuum Soc. Japan*, vol. 26, No. 1 (1983), pp. 22–29.

Ditmer, "Electrical Conduction and Electron Emission of Discontinuous Thin Films," *Thin Solid Films*, vol. 9 (1972), pp. 317–328.

Dyke and Dolan, "Field Emission," *Adv. Electronics and Electron Physics*, vol. VIII (1956), pp. 89–185.

Elinson, et al., "The Emission of Hot Electrons and the Field Emission of Electrons from Tin Oxide," *Radio Engineering and Electric Physics*, vol. 10, No. 7 (1965), pp. 1290–1296.

Hartwell and Fonstad, "Strong Electron Emission from Patterned Tin–Indium Oxide Thin Films," *International Electron Devices Meeting Technical Digest*, (1975), pp. 519–521.

Mead, "Operation of Tunnel–Emission Devices," *J. Applied Physics*, vol. 32 No. 4 (1961), pp. 646–652.

Spindt, et al., "Physical properties of thin–film field emission cathodes with molybdenum cones," *J. Applied Physics*, vol. 47, No. 12 (1976), pp. 5248–5263.

* cited by examiner

*Primary Examiner*—Kenneth J. Ramsey
(74) *Attorney, Agent, or Firm*—Fitzpatrick, Cella, Harper & Scinto

(57) ABSTRACT

In a method for producing an electron source substrate having a matrix of electron emitting elements formed by dispensing droplets of a solution containing a material for conductive thin film between each pair of element electrodes arranged in a matrix pattern on substrate, by use of an ink jet device, the ink jet device is the one having plural nozzles, delivery amounts of the respective nozzles are detected, the delivery amounts of the respective nozzles are adjusted based on the detection results, and thereafter dispensing of the droplets is carried out, during the dispensing of droplets, the substrate is moved relative to the ink jet device, and the droplets are dispensed from the plural nozzles to areas between each pair of element electrodes in plural rows or columns simultaneously and in parallel. An image forming apparatus is produced by placing at least a face plate equipped with fluorescent substance opposite the electron source substrate produced by the above method.

16 Claims, 20 Drawing Sheets

DRIVING PULSE (BEFORE CORRECTION)

DRIVING PULSE (AFTER CORRECTION)

METHOD FOR PRODUCING ELECTRON SOURCE HAVING ELECTRON EMITTING PORTIONS, AND APPARATUS FOR PRODUCING ELECTRON SOURCE

BACKGROUND OF THE INVENTION

1. Field of the Invention

The present invention relates to a method for producing an electron source having electron emitting portions. The present invention also relates to an electron source produced by the producing method thereof, an image forming apparatus using the electron source, and an apparatus for producing the electron source.

2. Related Background Art

The electron emitting elements conventionally known are roughly classified under two types using thermionic emission elements and cold emission elements. Examples of the cold emission elements are electron emitting elements of a field emission type (hereinafter referred to as "FE type"), a metal/insulator/metal type (hereinafter referred to as "MIM type"), a surface conduction type, and so on. Examples of the FE type known are those disclosed in W. P. Dyke & W. W. Doran, "Field Emission," Advance in Electron Physics, 8, 89 (1956), C. A. Spindt, "Physical Properties of thin-film field emission cathodes with molybdenum cones," J. Appl. Phys., 47, 5248 (1976), and so on. An example of the MIM type known is the one as disclosed in C. A. Mead, "Operation of Tunnel-Emission Devices," J. Appl. Phys., 32, 646 (1961), for example.

An example of the surface conduction type electron emitting element is the one as disclosed in M. I. Elinson, Radio Eng. Electron Phys., 10, 1290 (1965), for example.

The surface conduction type electron emitting element emits electrons when a current is allowed to flow in parallel to the film plane through a thin film of a small area formed on a substrate. There are reports on this surface conduction type electron emitting element; for example, those using Au thin film [G. Dittmer: Thin Solid Films, 9, 317 (1972)], using $In_2O_3/SnO_2$ thin film [M. Hartwell and C. G. Fonstad: IEEE Trans. ED Conf., 519 (1975)], using carbon thin film [Hisashi Araki et al.: Vacuum, Vol 26, No. 1, p 22 (1983)], and so on.

FIG. 21 schematically shows the element configuration of M. Hartwell, as described above, as a typical example of these surface conduction type electron emitting elements. In the same figure reference numeral 1 designates a substrate. Numeral 4 represents a conductive thin film, which is, for example, a thin film of metal oxide formed in a pattern of H-shape by sputtering. An electron emitting section 5 is formed by an electrification process called "electric forming" as detailed hereinafter. The distance L1 between the element electrodes in the drawing is set to 0.5 to 1 mm and the width W' to 0.1 mm. Since the position and shape of the electron emitting section 5 are not described specifically, the element is illustrated as a schematic view.

In these conventional surface conduction type electron emitting elements, the electron emitting section 5 is formed generally by preliminarily subjecting the conductive thin film 4 to the electrification process called the electric forming prior to emission of electron. The electric forming is formation of the electron emitting section by electrification, which is achieved, for example, by applying a dc voltage or very slowly increasing voltages to the both ends of the conductive thin film 4 to effect electrification, so as to locally break, deform, or alter the conductive thin film, thereby forming the electron emitting section 5 kept in an electrically high resistance state. The electron emitting section 5 has a crack produced in a part of the conductive thin film 4 and emits electrons from near the crack. The surface conduction type electron emitting element processed by the aforementioned electric forming process emits electrons from the above-stated electron emitting section 5 when the voltage is applied to the conductive thin film 4 to allow the current to flow through the element.

The surface conduction type electron emitting elements described above have the advantage that a lot of surface conduction type emitting elements can be arrayed over a large area, because the structure is simple and they can be produced using the conventional semiconductor fabrication technology. There are researches on such various applications as to make use of this feature. Examples of the applications are image forming apparatus such as charged electron beam sources and display devices.

FIG. 20 shows the structure of the electron emitting element disclosed in the official gazette of Japanese Laid-open Patent Application No. 2-56822 filed by Applicant. In the same figure, numeral 1 denotes a substrate, 2 and 3 element electrodes, 4 a conductive thin film, and 5 an electron emitting section. There are a variety of methods for producing this electron emitting element. For example, the element electrodes 2 and 3 are formed on the substrate 1 by the vacuum thin film technology and photolithography etching technology in the ordinary semiconductor processes.

Then the conductive thin film 4 is formed by a dispersion coating method such as spin coating, or the like. After that, the voltage is applied to the element electrodes 2, 3 to carry out the electrification process, thereby forming the electron emitting section 5.

This production method in the conventional example has drawbacks that large-scale photolithography etching facilities are necessary and indispensable for forming the elements over a large area, the number of steps is also large, and the production cost is thus high. In view of these drawbacks, there are proposals on a method for directly dispensing droplets of a solution containing a metal element by the ink jet method, as a method for patterning the conductive thin film of the surface conduction type electron emitting elements without use of the semiconductor processes (for example, as disclosed in Japanese Laid-open Patent Application No. 8-171850).

Since the conventional ink jet method as described in the official gazette of Japanese Laid-open Patent Application No. 8-171850 etc. is a method for directly dispensing a droplet from a droplet dispensing device 6 having a single nozzle as shown in FIGS. 19A, 19B, and 19C and since a lot of time is needed for scribing of one substrate in case an area of substrate is increased more and more, there is the limit of increase in throughput, however.

The present invention provides a method for producing an electron source by adopting a novel method for dispensing the material for the electron emitting section.

SUMMARY OF THE INVENTION

An aspect of the invention is a method for producing an electron source, as described below.

The method is a method for producing an electron source having a plurality of electron emitting portions, said method comprising steps of:

outputting a material for formation of said electron emitting portions from each of plural output portions for respectively outputting the material; detecting a dispensing state from each output portion; adjusting the dispensing state from each output portion, based on a result of the detecting step; and dispensing said material to objective portions to which said material is to be dispensed, in the dispensing state adjusted in said adjusting step.

Here, the output portions are, for example, nozzles. The material is outputted, for example, in a liquid state. More specifically, the material is outputted in a state of droplet. The material may be a material of conductive film for forming the electron emitting portions.

In the above invention, the dispensing state adjusted is a delivery amount from each output portion.

In the above invention, the dispensing operation of the material can be done well by relatively moving the output portions relative to the objective portions.

In the above invention, the adjusting of the dispensing state can be done well by adjusting a driving signal for dispensing the material from each output portion. More specifically, the adjustment can be done by adjusting a waveform of the driving signal, and the adjustment is carried out for each output portion.

In the above invention, the dispensing of the material is dispensing of a solution containing at least the material. In this case, the dispensing of the material can be done well by the ink jet method.

In the above invention, the dispensing of the material can also be done well by a method for generating a bubble in the material by use of thermal energy and discharging the material, based on the generation of the bubble; or the dispensing of the material can also be done well by dispensing the material by a piezoelectric device.

In the above invention, the electron emitting portions are, for example, provided between the element electrodes. Particularly, each of the electron emitting portions is, for example, provided in a conductive thin film between a pair of element electrodes of a surface conduction type electron emitting element, and the material is, for example, a material for the conductive thin film.

In the above invention, the method may further comprise a step of forming the electron emitting portions by electrification of the material deposited on the objective portions. For example, the step may comprise a step of electric forming for forming the electron emitting portions by electrification of the conductive film of the material dispensed, and the step may also comprise an activation step of depositing carbon or a carbon compound on a crack portion formed in the conductive film of the material dispensed.

In the above invention, the material is, for example, one containing an electrically conductive material.

In the above invention, the adjustment of the dispensing state is, for example, such adjustment as to equal the dispensing states from the respective output portions. More specifically, the adjustment is such adjustment as to equal delivery amounts from the output portions.

In the above invention, each of said plural output portions corresponds to one of plural areas each having a plurality of said objective portions and each output portion successively dispenses said material to the plurality of objective portions in a corresponding area.

In the case of the structure wherein each of said plural output portions corresponds to one of plural areas each having a plurality of said objective portions and each output portion successively dispenses said material to the plurality of objective portions in a corresponding area, this structure is preferred in that the amount of relative movement between the output portions and the substrate can be decreased, and, particularly, the present invention capable of adjusting the delivery amounts from the respective output portions can be suitably applied to this structure.

The present invention also involves an electron source produced by either one of the above-stated methods for producing the electron source.

The present invention also involves a method for producing an image forming apparatus, the method comprising a step of placing a member for forming an image with electrons emitted from the electron emitting portions of the electron source, opposite the electron source.

The present invention also involves an image forming apparatus produced by the method for producing it.

An apparatus for producing an electron source according to the present invention is constructed as follows.

The apparatus is an apparatus for producing an electron source having a plurality of electron emitting portions, said apparatus comprising:

a plurality of output portions for respectively outputting a material for formation of said electron emitting portions; and adjusting means for adjusting a dispensing state from each output portion, based on a result of detection of the dispensing state from each of the plurality of output portions.

In the invention, the apparatus preferably further comprises means for relatively moving the output portions relative to the objective portions.

DETAILED DESCRIPTION OF THE PREFERRED EMBODIMENTS

The preferred embodiments of the present invention will be described below.

Figure 10A:
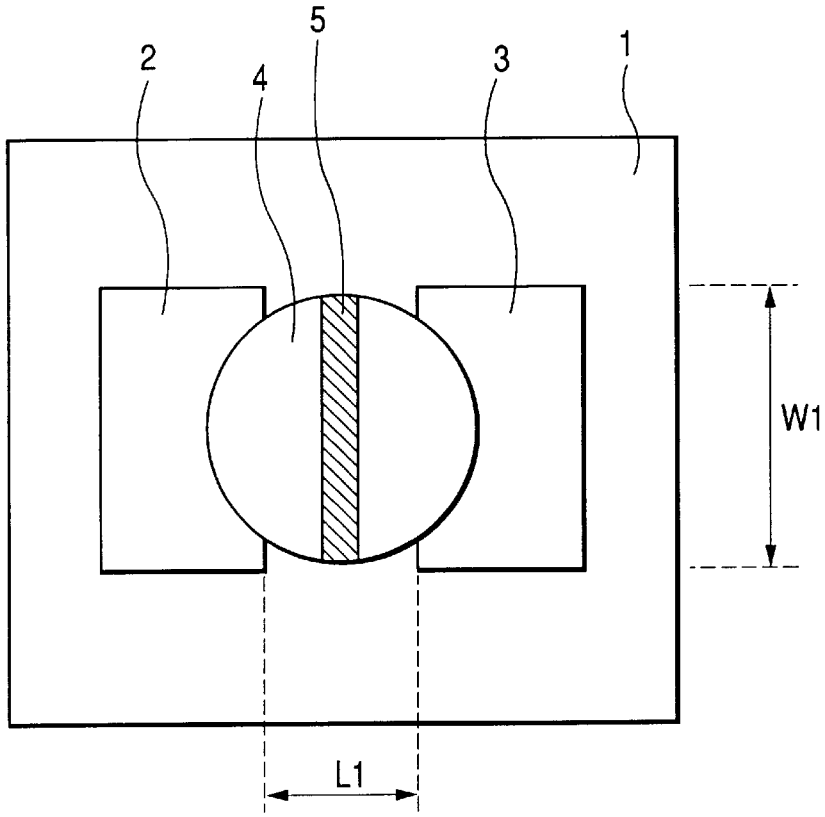
FIGS. 10A and 10B are a schematic plan view and a sectional view to show the structure of a surface conduction type electron emitting element to which the present invention is applied.
Figure 10B:
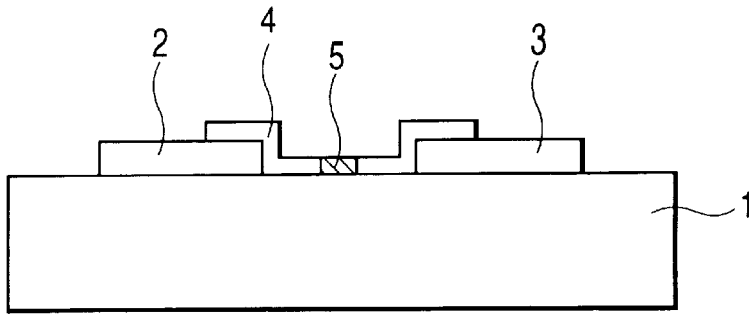

FIGS. 10A and 10B are schematic views to show the structure of a surface conduction type electron emitting element according to an embodiment of the present invention, wherein FIG. 10A is a plan view and FIG. 10B is a sectional view. In FIGS. 10A and 10B reference numeral 1 designates a substrate, 2 and 3 element electrodes, 4 an electroconductive thin film, and 5 an electron emitting section.

The substrate 1 can be either one selected from quartz glass, glass with a reduced content of an impurity such as Na, blue sheet glass, a glass substrate on the surface of which $SiO_2$ is deposited, a substrate of a ceramic material such as alumina, and so on.

The material for the opposed element electrodes 2, 3 can be selected from a variety of conductive materials; e.g., printed conductors comprised of metal or alloy of Ni, Cr, Au, Mo, W, Pt, Ti, Al, Cu, Pd, or the like and metal or metal oxide of Pd, As, Ag, Au, $RuO_2$, Pd—Ag, or the like with glass or the like, transparent conductors such as $In_2O_3$—$SnO_2$, and semiconductor/conductor materials such as polysilicon, and so on.

The distance L1 between the element electrodes, the length W1 of the element electrodes, the shape of conductive thin film 4, and so on are designed taking account of application forms and other factors. The electrode distance L1 is preferably in the range of several thousand Å to several hundred μm and more preferably in the range of 1 μm to 100 μm in view of the voltage applied between the element electrodes or the like.

The element length W1 is in the range of several μm to several hundred μm in view of the resistance of the electrodes and electron emission characteristics. The thickness d of the element electrodes 2, 3 is in the range of 100 Å to 1 μm. The electron emitting element is not made only in the structure shown in FIGS. 10A and 10B, but may also be made in another structure where the conductive thin film 4 and the opposed electrodes 2, 3 are laid in the named order on the substrate 1.

The conductive thin film 4 is preferably a fine particle film comprised of fine particles, in order to obtain good electron emission characteristics. The thickness of the thin film 4 is properly determined in view of step coverage for the element electrodes 2, 3, the resistance between the element electrodes 2, 3, forming conditions described hereinafter, and so on. The thickness of the thin film 4 is normally preferably in the range of several Å to several thousand Å and more preferably in the range of 10 Å to 500 Å. The resistance of the thin film 4 is determined so that Rs is a value in the range of $10^2$ to $10^7$ Ω. Rs is a value obtained when the resistance R of the thin film having the thickness t, the width w, and the length 1 is defined as R=Rs (l/w), and it is expressed by Rs=ρ/t where ρ is the resistivity of the material for the thin film. In the present specification, the forming process will be described with examples of electrification process, but the forming process is not limited to this process. The forming process may be any method that can form the high resistance state by producing the crack in the film.

The material for the conductive thin film 4 is properly selected from metals such as Pd, Pt, Ru, Ag, Au, Ti, In, Cu, Cr, Fe, Zn, Sn, Ta, W, and Pb; oxides such as PdO, $SnO_2$, $In_2O_3$, PbO, and $Sb_2O_3$; borides such as $HfB_2$, $ZrB_2$, $LaB_6$, $CeB_6$, $YB_4$, and $GdB_4$; carbides such as TiC, ZrC, HfC, TaC, SiC, and WC; nitrides such as TiN, ZrN, and HfN; semiconductors of Si, Ge, or the like; carbon, and so on.

The fine particle film stated herein is a film as an aggregate of plural fine particles and the microstructure thereof is a state in which the fine particles are dispersed separately or a state in which the fine particles are adjacent or overlap each other (including a state in which some fine particles aggregate to form the island structure as a whole). Particle sizes of the fine particles are in the range of several Å to 1 μmand preferably in the range of 10 Å to 200 Å.

The electron emitting section 5 shown in FIGS. 10A and 10B will be described. The electron emitting section 5 is comprised of the crack of high resistance formed in a part of the conductive thin film 4 and is dependent on the thickness of the conductive thin film 4, the quality of the film, the material for the film, the techniques such as the electric forming described hereinafter, and so on. In some cases the electron emitting section 5 contains conductive fine particles having the particle sizes of 1000 Å or less. The conductive fine particles are those containing some elements or the all elements of the material making the conductive thin film 4. The electron emitting section 5 and the conductive thin film 4 in the vicinity thereof may contain carbon or a carbon compound.

Next described is a method for forming the conductive thin film of the surface conduction type electron emitting element according to the present invention. The mechanism of droplet dispensing head unit used in the present invention may be any mechanism that can dispense a constant amount of arbitrary liquid and particularly, it may be, for example, a mechanism of the ink jet method capable of forming a droplet of approximately several ten ng. The ink jet method may be either one of the piezo jet method using the piezoelectric device, the bubble jet method to generate a bubble by use of thermal energy of heater, and so on.

Figure 11:
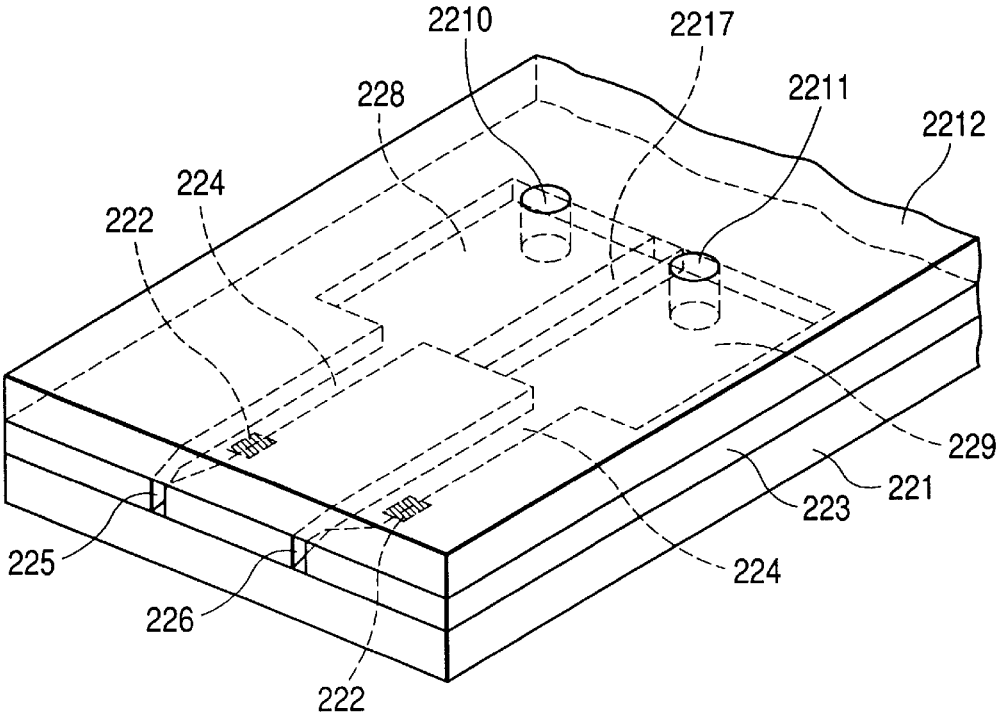
FIG. 11 is a drawing to show an example of an ink jet apparatus that can be used in the present invention.
Figure 12:
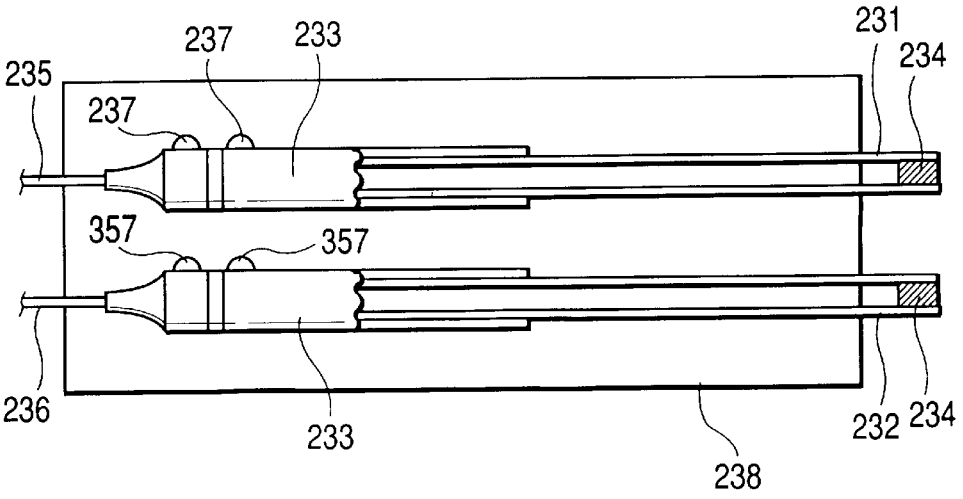
FIG. 12 is a drawing to show another example of an ink jet apparatus that can be used in the present invention.

Examples of the droplet dispensing device of the ink jet method, which are used in the present invention, are shown in FIGS. 11 and 12. FIG. 11 illustrates the structure of the droplet dispensing device of the bubble jet method. In the same figure, numeral 221 denotes a substrate, 222 heat generating sections, 223 a support substrate, 224 liquid flow paths, 225 a first nozzle, 226 a second nozzle, 2217 a partition wall between ink flow paths, 228, 229 ink fluid chambers, 2210, 2211 supply ports of ink fluid, and 2212 a ceiling board.

FIG. 12 shows the structure of the droplet dispensing device of the piezo jet method. In FIG. 12 numeral 231 designates a first nozzle made of glass, 232 a second nozzle made of glass, 233 cylindrical piezoelectric devices, 234 filters, 235, 236 ink fluid supply tubes, and 237 input terminals for electric signal. In FIGS. 11 and 12 there are two nozzles illustrated, but the number of nozzles is not limited to 2.

In the present invention, a plurality of ink dispensing nozzles are used for dispensing droplets of solution to the respective element portions on the substrate. If in this case there are large manufacture errors among the plural ink dispensing nozzles, dispersion will appear in delivery amounts of ink among the nozzles and it will become hard to form many conductive thin film areas with small dispersion in the resistance and the shape. The present invention thus provides a production method comprising (1) a step of detecting delivery amounts of the respective nozzles used, (2) a delivery amount correcting step of setting driving pulses applied for dispensing, for every nozzle, based on the information of delivery amounts detected, and (3) a step of forming a conductive thin film by dispensing at least one droplet of solution to each element portion on the substrate from the plural nozzles for dispensing, using the driving pulses preliminarily set, whereby the invention permits many conductive thin film areas to be formed with less dispersion in the resistance and the shape by use of the plural nozzles.

The steps (1) to (3) will be explained below in order.

In (1) the step of detecting the delivery amounts of the plural nozzles used, first, detection is carried out of the delivery amounts of the plural nozzles used in the later step of (3). The amount detected may be the weight or the volume of droplet, but other possible factors are an amount of substance or an electrical characteristic such as the resistance in the state of the conductive thin film obtained by baking the dispensed droplet of organic metal to thermally decompose it.

Next described is (2) the delivery amount correcting step of setting the driving pulses applied for dispensing, for every nozzle, based on the information of the delivery amounts detected. The volume of a droplet dispensed by the ink jet head can be controlled by controlling the driving pulse applied to a piezoelectric device or to a thermal energy transformer, for example, by controlling the voltage, the pulse width, or the pulse shape; in the case of the piezo jet method, by changing a displacement amount of the piezoelectric element; in the case of the bubble jet method, by changing the size of a bubble generated on the thermal energy transformer.

Particularly, in the case of the piezo jet method, the adjustment of delivery amount can be performed under good control in a wide range, because the displacement amount of the piezoelectric device can be readily changed by controlling the driving pulse applied thereto.

Thus, the driving pulses are corrected according to deviation amounts from a predetermined delivery amount, detected in the step of (1), so as to correct the ink delivery amounts from the respective ink dispensing nozzles to a predetermined value. The driving pulses for the respective nozzles set this time are those used during dispensing of droplet in the step of (3).

Next described is (3) the step of forming the conductive thin film by dispensing at least one droplet of solution to each element portion on the substrate from the plural nozzles for dispensing, using the driving pulses set in the above delivery amount correcting step. Material for the droplet 8 can be one selected from solutions, organic solvents, etc. containing an element or a compound that can make the conductive thin film described previously. For example, the following materials are examples where the element or the compound to become the conductive thin film is a palladium based one; aqueous solutions containing an ethanolamine-based complex such as palladium acetate-monoethanolamine complex (PA-ME), palladium acetate-diethanolamine complex (PA-DE), palladium acetate-triethanolamine complex (PA-TE), palladium acetate-butyl ethanolamine complex (PA-BE), or palladium acetate-dimethyl ethanolamine complex (PA-DME); aqueous solutions containing an amino-acid-based complex such as palladium-glycine complex (Pd-Gly), palladium-β-alanine complex (Pd-β-Ala), or palladium-DL-alanine complex (Pd-DL-Ala); butyl acetate solution of palladium acetate-bisdipropylamine complex, and so on.

Figure 1:
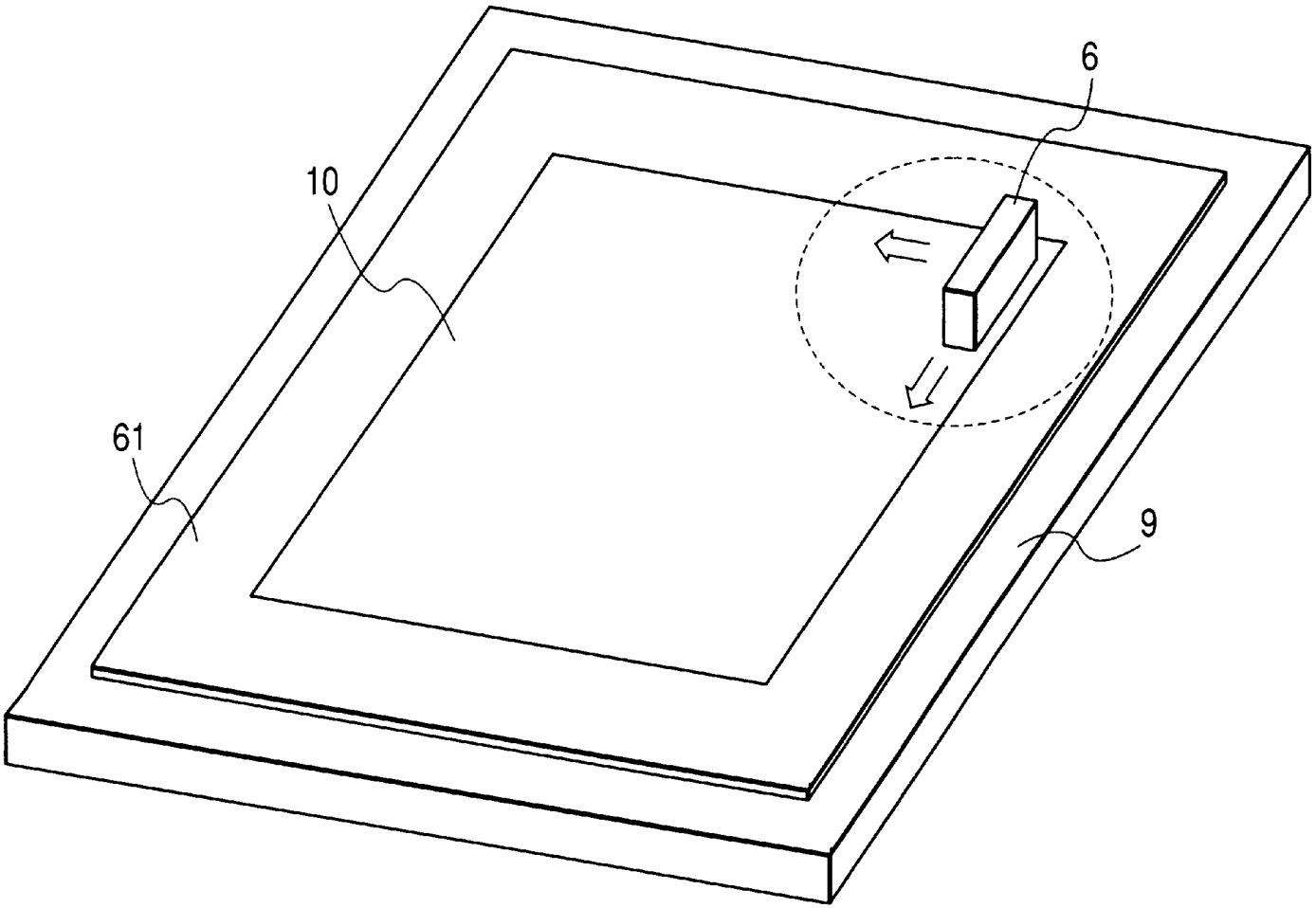
FIG. 1 is a schematic structural diagram to show a droplet dispensing method in the first embodiment of the present invention.

As shown in FIG. 1, at least one droplet of the solution is dispensed to each element portion on the substrate by relatively moving the substrate to be coated, relative to the m nozzles and using the m nozzles of the ink jet device across the area of element section to which the droplets are to be dispensed on the substrate to be coated. Since on this occasion the delivery amounts of droplets from the respective nozzles used are adjusted by applying the driving pulses set in (2) to the respective nozzles, the dispensing operations of droplets can be performed with less dispersion in the delivery amounts throughout the entire surface of substrate, even though the dispensing operations of droplets are carried out using the m nozzles.

Since the present invention employs the m nozzles, the apparatus has the droplet dispensing performance m times higher than in the case where the droplets are dispensed by use of a single nozzle. When processing of a same substrate to be coated is carried out at same speed of relative movement, the method of the present invention can perform the processing in a period equal to 1/m times that in the case with the single nozzle, so that the throughput can be increased.

The organic metal droplets dispensed onto the substrate in the described manner were baked to be thermally decomposed, thus forming the conductive thin film areas. Since the present invention permits the droplets to be dispensed with less dispersion in the delivery amounts throughout the entire surface of the substrate, the conductive thin film areas formed have less dispersion in the resistance and the shape.

Figure 13A:
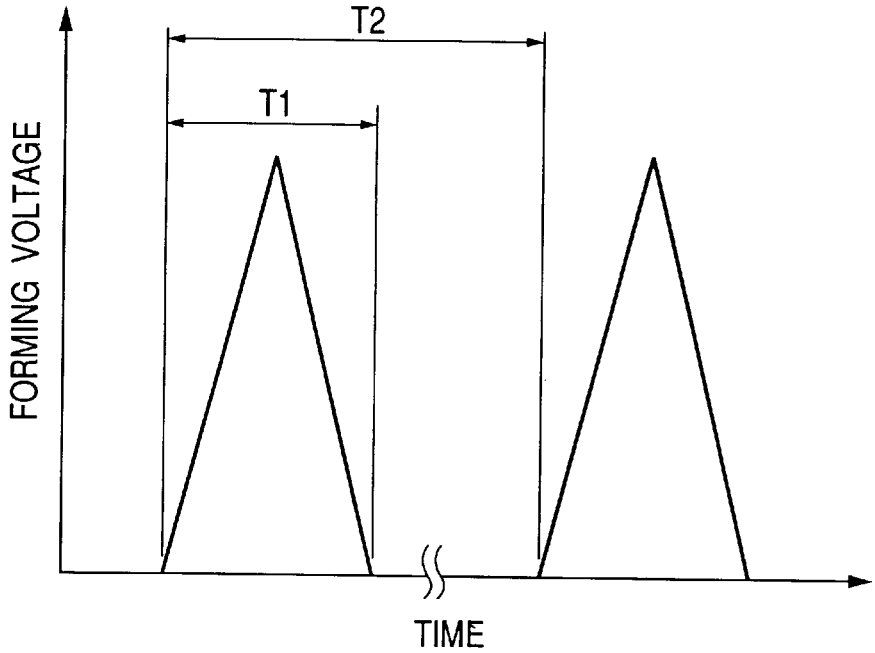
FIGS. 13A and 13B are schematic diagrams to show examples of voltage waveforms in the electric forming process, which can be employed for production of the electron source substrate of the present invention.
Figure 13B:
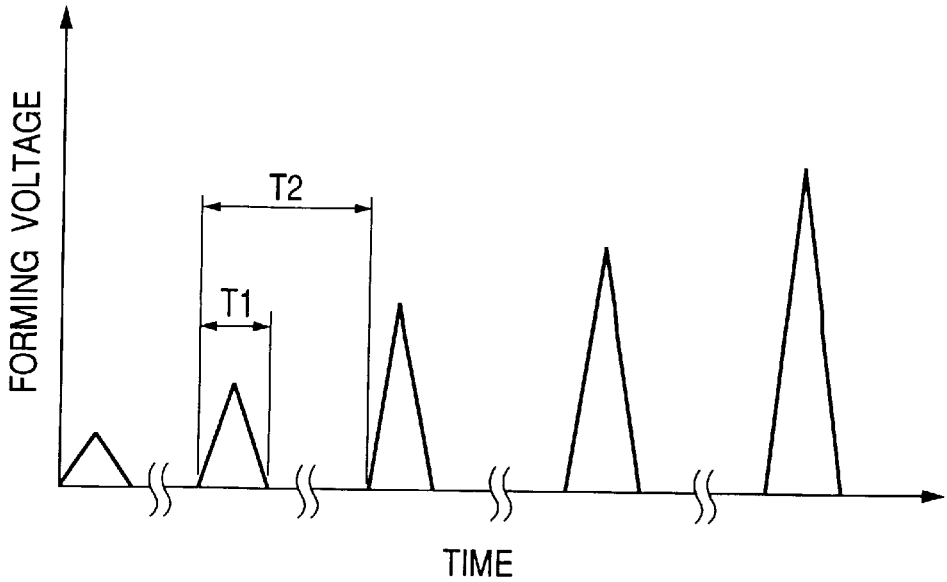
Figure 19A:
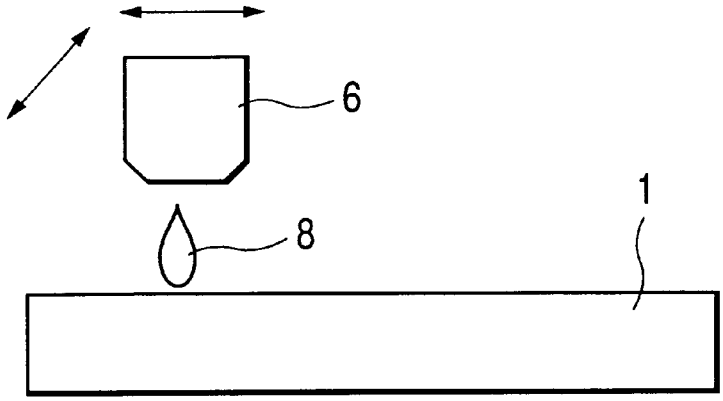
FIGS. 19A, 19B, and 19C are schematic views to show an example of the conventional droplet dispensing method.
Figure 19B:
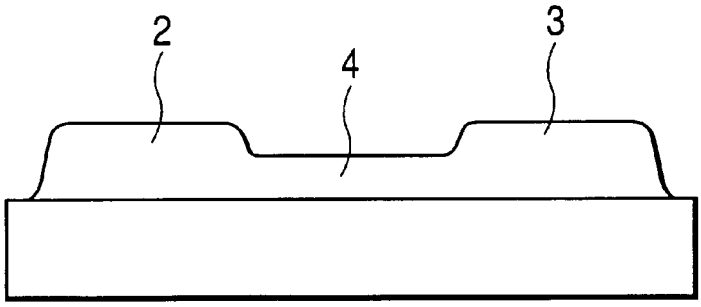
Figure 19C:
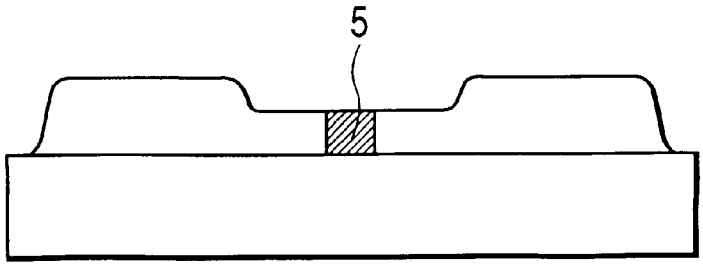
Figure 20:
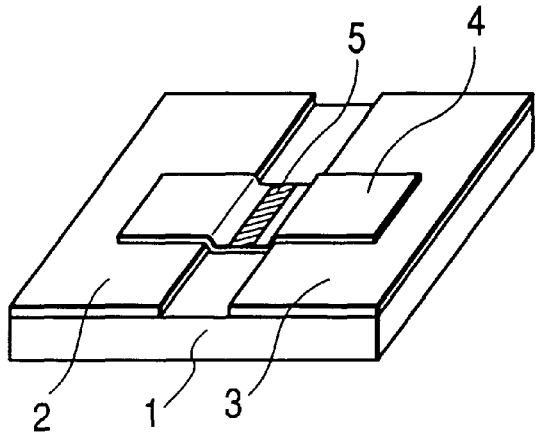
FIG. 20 is a schematic, perspective view of the conventional surface conduction type electron emitting element.
Figure 21:
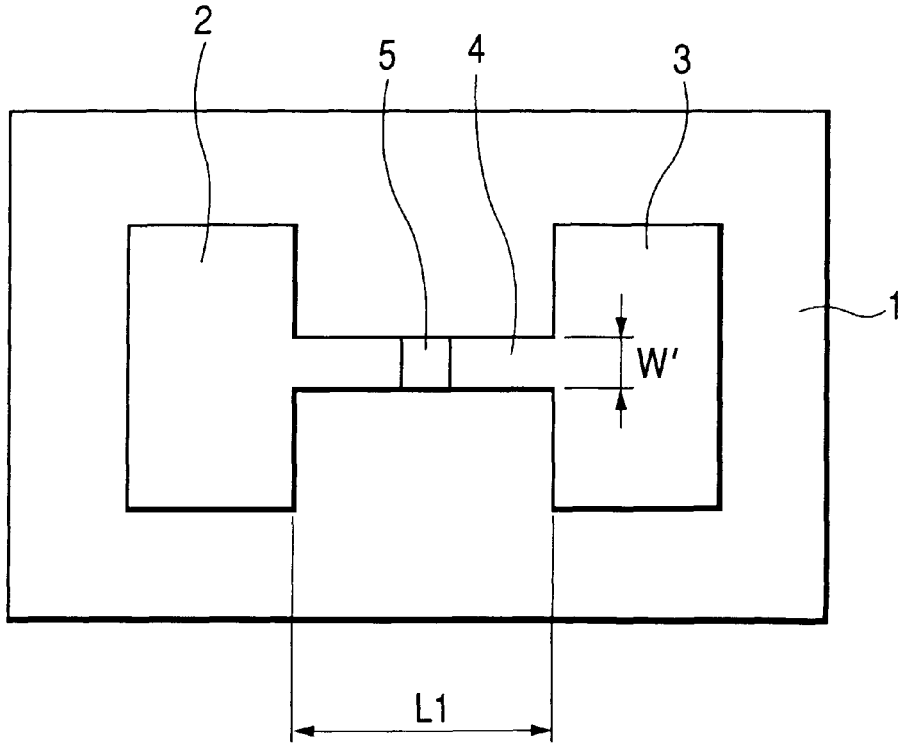
FIG. 21 is a schematic, plan view of the conventional surface conduction type electron emitting element.

The conductive thin film 4 thus formed undergoes the forming process. A method by the electrification process will be described as an example of this forming method. When power from a power supply not illustrated is placed between the element electrodes 2, 3, a portion of the conductive thin film 4 experiences change of structure, thereby forming the electron emitting section 5 (FIG. 19C). This electric forming forms the structure-changed portion, locally broken, deformed, or altered, in the conductive thin film 4. This portion becomes the electron emitting section 5. FIGS. 13A and 13B show examples of waveforms of voltage for the electric forming. The waveforms of voltage are preferably of a pulse shape. There are two techniques for applying such pulses; a technique for continuously applying pulses whose pulse peak value is a constant voltage, as shown in FIG. 13A; a technique for applying voltage pulses with increasing pulse peak values, as shown in FIG. 13B.

In FIG. 13A T1 and T2 represent the pulse width and pulse interval of voltage waveform. The pulse width T1 is normally set in the range of 1 $\mu$sec to 10 msec and the pulse interval T2 normally in the range of 10 $\mu$sec to 100 msec. The peak value of triangular wave (the peak voltage upon the electric forming) is properly selected according to the form of the surface conduction type electron emitting element. Under these conditions, the voltage is applied for several seconds to several ten minutes, for example. The pulse waveform is not limited to the triangular wave, but a desired waveform, for example such as a rectangular wave, may also be adopted.

In FIG. 13B T1 and T2 may be the same as those shown in FIG. 13A. The peak values of triangular waves (peak voltages upon the electric forming) can be increased, for example, in steps of about 0.1 V.

Completion of the electric forming process can be detected by applying a voltage too low to locally break or deform the conductive thin film 4 during the period of pulse interval T2 and measuring a current. For example, the voltage of about 0.1 V is applied and the element current is measured to obtain a resistance at that time. When the resistance reaches 1 MΩ or more, the electric forming is terminated.

The element after forming is preferably subjected to an activation treatment. The activation step considerably changes the element current If and emission current Ie.

The activation treatment can be effected by repetitively applying pulses, in the same manner as in the case of the electric forming, under an atmosphere containing a gas of organic substance, for example. This atmosphere can be formed, for example, by utilizing an organic gas remaining in the atmosphere where the inside of a vacuum container is evacuated using an oil diffusion pump or a rotary pump; or by introducing a gas of appropriate organic substance into a vacuum achieved after sufficient evacuation with an ion pump or the like. The preferred pressure of the gas of organic substance at this time is properly determined depending upon the circumstance, because the pressure differs depending upon the form of application described above, the shape of the vacuum container, the type of the organic substance, and so on. The appropriate organic substance is selected from aliphatic hydrocarbons of alkane, alkene, and alkyne, aromatic hydrocarbons, alcohols, aldehydes, ketones, amines, organic acids such as phenol, carboxylic acid, and sulfonic acid, and so on; more specifically, saturated hydrocarbons represented by $C_nH_{2n+2}$ such as methane, ethane, or propane; unsaturated hydrocarbons represented by the composition formula of $C_nH_{2n}$ or the like such as ethylene or propylene; benzene, toluene, methanol, ethanol, formaldehyde, acetaldehyde, acetone, methyl ethyl ketone, methylamine, ethylamine, phenol, formic acid, acetic acid, propionic acid, and so on. This treatment causes carbon or a carbon compound to be deposited on the element from the organic substance present in the atmosphere, whereby the element current If and emission current Ie are changed remarkably. Completion of the activation step is determined by measuring the element current If and emission current Ie. The pulse width, the pulse interval, and the pulse peak value are determined as occasion may demand.

The carbon or carbon compound described above is graphite (including the both monocrystalline and polycrystalline graphite) or amorphous carbon (amorphous carbon and carbon containing a microcrystalline mixture of amorphous carbon and the graphite), and the thickness thereof is preferably not more than 500 Å and more preferably not more than 300 Å.

The electron emitting element obtained through the activation step is preferably subjected to a stabilization treatment. This treatment is carried out preferably under such a condition that the partial pressure of the organic substance in the vacuum container is $1\times10^{-8}$ Torr or less, desirably not more than $1\times10^{-10}$ Torr. The pressure inside the vacuum container is preferably $1\times10^{-6.5}$ to $10^{-7}$ Torr and particularly preferably not more than $1\times10^{-8}$ Torr. A vacuum evacuation device for evacuating the vacuum container is preferably one not using oil, in order to prevent the oil from the device from affecting the characteristics of element. Specifically, such devices are vacuum evacuating devices such as an absorption pump and an ion pump. When the inside of the vacuum container is evacuated, the whole vacuum container is preferably heated, thereby facilitating evacuation of molecules of the organic substance adsorbing on the internal wall of the vacuum container and on the electron emitting element. The evacuation conditions in the heated state at this time are desirably 80 to 200° C. for 5 or more hours, but, without being limited particularly to these conditions, the evacuation conditions vary depending upon various conditions including the size and shape of the vacuum container, the configuration of the electron emitting element, and so on. The partial pressure of the organic substance is obtained by measuring partial pressures of organic molecules whose principal components are carbon and hydrogen and whose mass numbers are 10 to 200 by mass spectrometer and adding up those partial pressures.

The atmosphere during driving after completion of the stabilization step is preferably the one at completion of the above stabilization treatment, but, without having to be limited to this, sufficiently stable characteristics can be maintained even with a little decrease in the degree of vacuum itself as long as the organic substance is removed well.

When this vacuum atmosphere is adopted, new carbon or carbon compound can be prevented from being deposited, which in turn stabilizes the element current If and emission current Ie.

Since the present invention permits the conductive thin film to be formed with less dispersion in the resistance and the shape throughout the entire surface of the substrate, the forming process thereafter can also be performed with little dispersion and the characteristics of the element after completion of the stabilization step also exhibit little dispersion throughout the entire surface of the substrate.

Image forming apparatus of the present invention will be described below.

A variety of configurations may be adopted for the electron emitting elements of electron source substrate used in the image forming apparatus. A first example is a ladder configuration in which a number of electron emitting elements arranged in parallel are connected each at the both ends to form many rows of electron emitting elements (defining the row direction) and in which electrons from the electron emitting elements are controlled and driven by control electrodes (also called a grid) disposed above the electron emitting elements and in the direction (called the column direction) perpendicular to the wires.

Another example is a configuration in which a plurality of electron emitting elements are arrayed in a matrix in the X-direction and in the Y-direction, one-side electrodes of plural electron emitting elements disposed in each of rows are connected to a common wire in the X-direction, and other-side electrodes of plural electron emitting elements disposed in each column are connected to a common wire in the Y-direction. This is a so-called simple matrix configuration. This simple matrix configuration will be detailed below.

Figure 14:
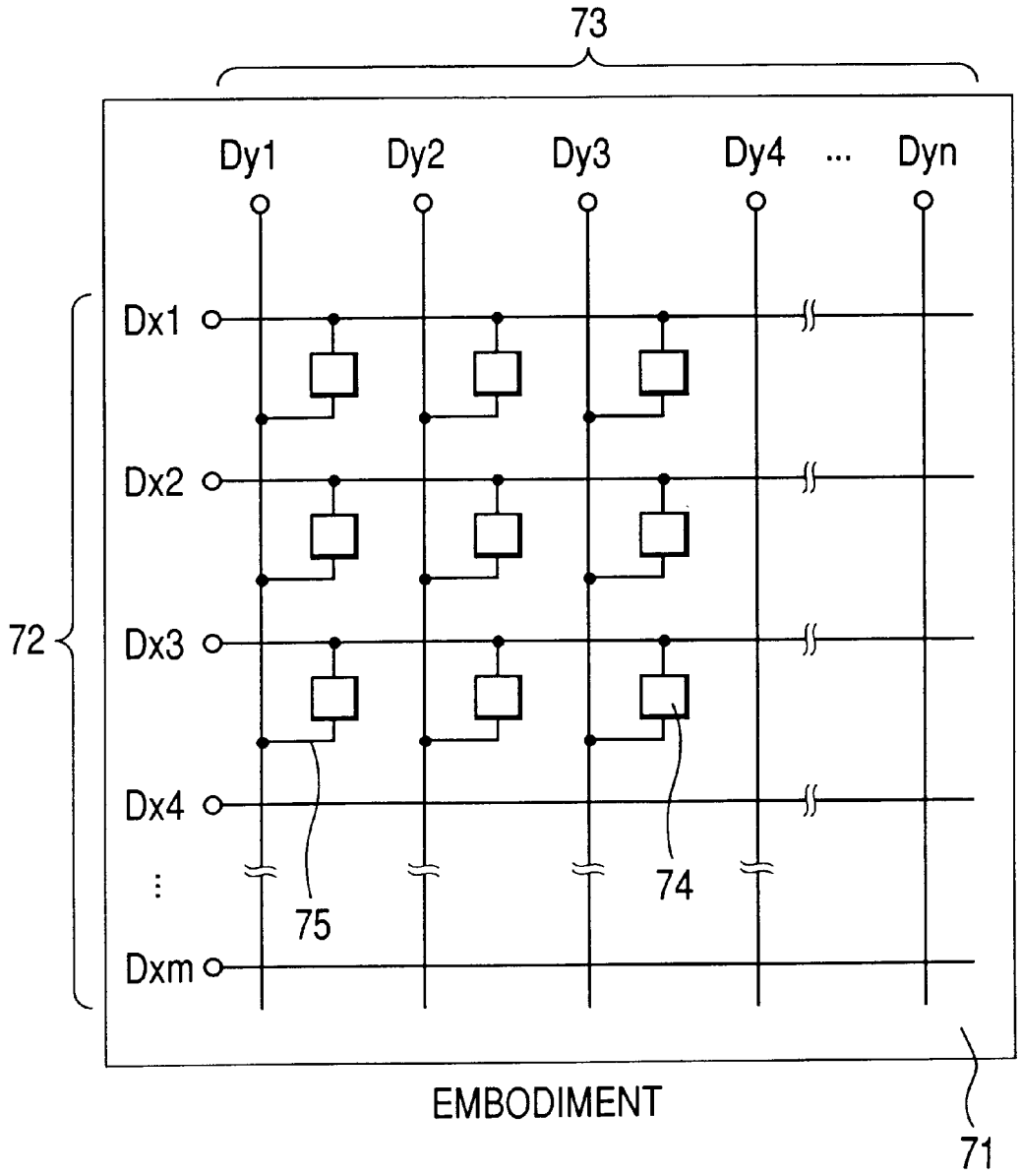
FIG. 14 is a schematic view to show the electron source substrate of the matrix configuration type that can be employed in the present invention.

Now, let us explain an electron source substrate obtained by arraying a plurality of electron emitting elements in a matrix according to the present invention, by reference to FIG. 14. In FIG. 14, reference numeral 71 designates an electron source substrate, 72 wires in the X-direction, and 73 wires in the Y-direction. Numeral 74 denotes surface conduction type electron emitting elements and 75 connections.

The m X-directional wires 72 are comprised of D×1, D×2, . . . , D×m, which can be made of a conductive metal or the like. The material, the thickness, and the width of the wires are properly designed as occasion may demand. The Y-directional wires 73 are comprised of n wires of Dy1, Dy2, . . . , Dyn, which are also made in the same manner as the X-directional wires 72. An interlayer insulating layer not illustrated is interposed between these m X-directional wires 72 and n Y-directional wires 73, so as to electrically isolate them from each other (where m and n both are positive integers).

The interlayer insulating layer not illustrated is made of $SiO_2$ or the like. The thickness, material, and production process of the interlayer insulating layer are determined so as to form the insulating layer in a desired shape entirely or partly on the substrate 71 with the X-directional wires 72 formed thereon and, particularly, so as to make the insulating layer resistant to a potential difference at intersections between the X-directional wires 72 and the Y-directional wires 73. Each of the X-directional wires 72 and Y-directional wires 73 is drawn out as an external terminal.

The paired electrodes (not illustrated), each pair for each of the surface conduction type electron emitting elements 74, are electrically connected with the m X-directional wires 72 and n Y-directional wires 73 by the connections 75 of the conductive metal or the like.

The material for the wires 72 and wires 73, the material for the connections 75, and the material for the paired element electrodes may contain some identical constituent elements or all identical constituent elements or may be different from each other. These materials are properly selected, for example, from the aforementioned materials for the element electrodes. When the material for the element electrodes is the same as the wire material, the wires connected to the element electrodes can also be regarded as element electrodes.

Connected to the X-directional wires 72 is a scan signal applying device, not illustrated, for applying a scan signal for selecting a row of surface conduction type emitting elements 74 arranged along the X-direction. On the other hand, connected to the Y-directional wires 73 is a modulation signal generator, not illustrated, for modulating each column of surface conduction type emitting elements 74 arranged along the Y-direction according to an input signal. A driving voltage applied to each electron emitting element is supplied as a difference voltage between the scan signal and the modulation signal applied to the element.

In the above configuration, the individual elements can be selected and driven independently, using the simple matrix wires.

Figure 15:
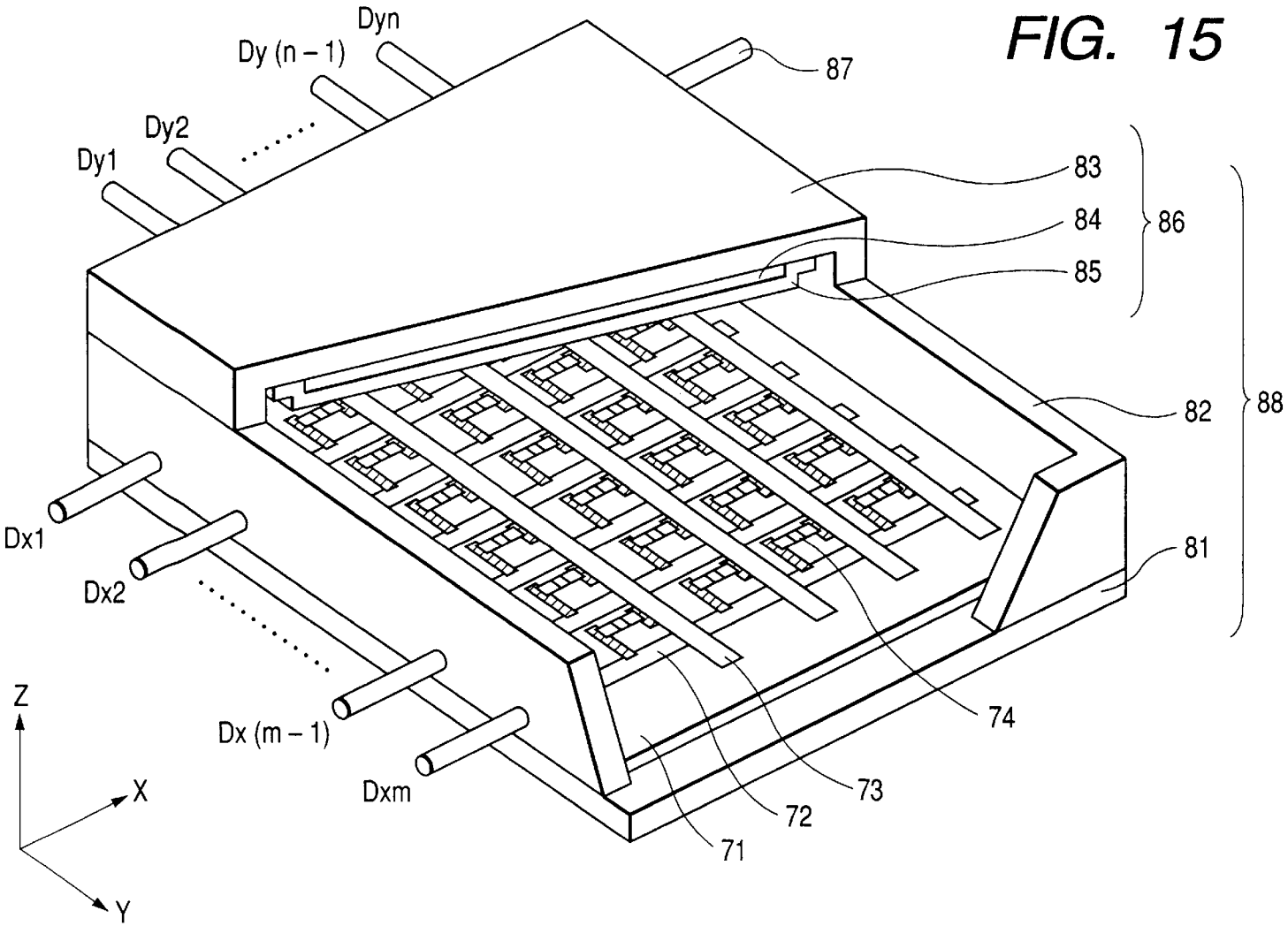
FIG. 15 is a schematic view to show a display panel of an image forming apparatus of matrix wires that can be employed in the present invention.
Figure 16A:
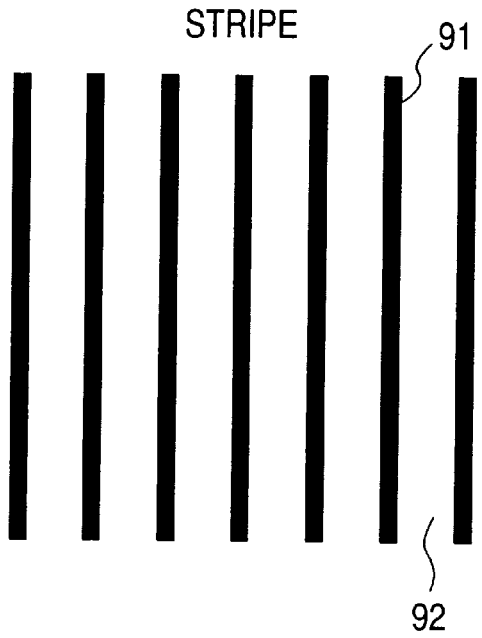
FIGS. 16A and 16B are schematic views to show examples of fluorescent film in the display panel of FIG. 15.
Figure 16B:
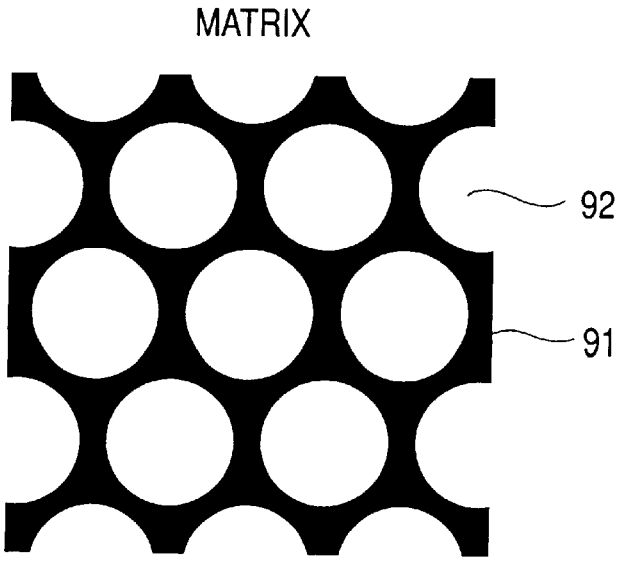
Figure 17:
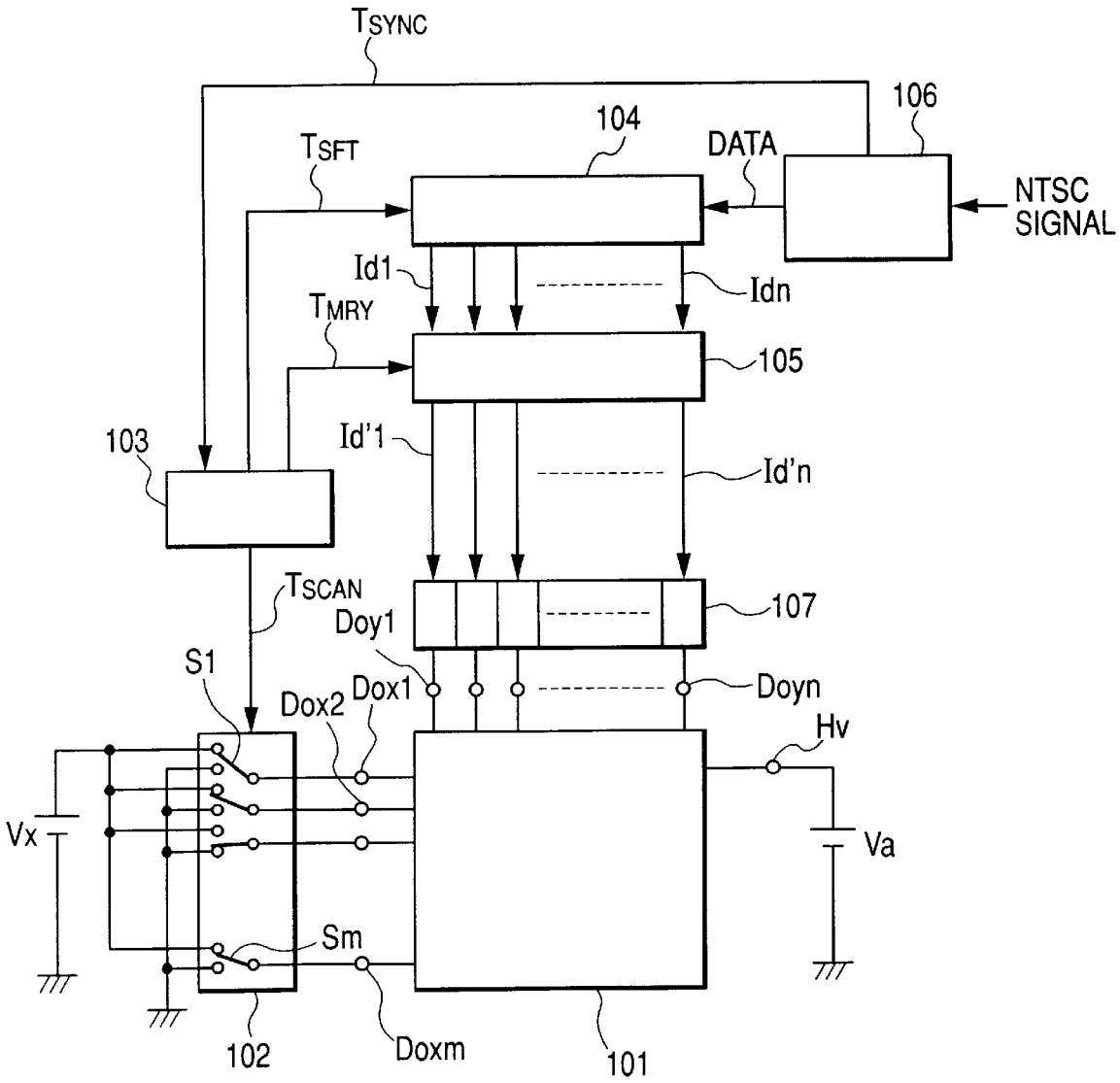
FIG. 17 is a block diagram to show an example of a driving circuit for display according to TV signals of the NTSC method, which can be employed in the image forming apparatus of the present invention.

An image forming apparatus constructed using the electron source of such a simple matrix configuration will be described referring to FIG. 15, FIGS. 16A and 16B, and FIG. 17. FIG. 15 is a schematic diagram to show an example of a display panel of the image forming apparatus and FIGS. 16A and 16B are schematic diagrams of fluorescent films used in the image forming apparatus in FIG. 15. FIG. 17 is a block diagram to show an example of a driving circuit for display according to TV signals of the NTSC method.

In FIG. 15, numeral 71 designates an electron source substrate on which a plurality of electron emitting elements are arrayed, as shown in FIG. 1, 81 a rear plate on which the electron source substrate 71 is fixed, and 86 a face plate in which fluorescent film 84 and metal back 85 are formed on the internal surface of glass substrate 83. Numeral 82 indicates a support frame, and the rear plate 81 and face plate 86 are connected to the support frame 82 by use of frit glass or the like. Numeral 88 represents an enclosure composed of these components, for example obtained by baking them in the temperature range of 400 to 500° C. in the atmosphere or in nitrogen for 10 or more minutes so as to effect sealing.

Numeral 74 corresponds to one element out of the surface conduction type electron emitting elements shown in FIGS. 10A and 10B. Numerals 72 and 73 denote the X-directional wires and Y-directional wires connected to the element electrodes of the respective pairs of surface conduction type electron emitting elements.

The enclosure 88 is composed of the face plate 86, support frame 82, and rear plate 81 as described above. Since the rear plate 81 is provided mainly for the purpose of reinforcing the electron source substrate 71, the separate rear plate 81 does not have to be provided if the electron source substrate 71 itself has sufficient strength. Namely, the enclosure 88 may be constructed of the face plate 86, support frame 82, and substrate 71 by coupling the substrate 71 directly with the support frame 82 by sealing. On the other hand, the enclosure 88 having sufficient strength against the atmospheric pressure can also be constructed by installing an unrepresented support called a spacer (atmospheric-pressure-resistant support member) between the face plate 86 and the rear plate 81.

FIGS. 16A and 16B are schematic diagrams to show examples of the fluorescent film. In the monochrome case the fluorescent film can be constructed of only fluorescent substance. A color fluorescent film can be made of black member 91 and fluorescent substance 92 in a pattern called black stripes or a black matrix depending upon the configuration of fluorescent substance. Purposes of providing the black stripes or black matrix are to quiet mixture of colors or the like by blacking the coating borders between the fluorescent areas 92 of the necessary three primary colors and to suppress decrease in contrast due to reflection of external light. The material for the black stripes can be a material whose principal component is graphite, which is normally used, or any material with little transmission and little reflection of light.

A method for coating the glass substrate 83 with the fluorescent substance is a precipitation method, a printing method, or the like, irrespective of either monochrome or color. The metal back 85 is normally provided on the internal surface of the fluorescent film 84. Purposes for provision of the metal back are to increase the luminance by regularly reflecting light on the internal surface side out of emission light from the fluorescent substance, toward the face plate 86 side, to make the metal back act as an electrode for applying an electron beam accelerating voltage, to protect the fluorescent substance from damage due to collision with negative ions generated in the enclosure, and so on. The metal back can be made in such a way that after production of the fluorescent film, a smoothing process (normally called "filming") is carried out for the surface on the internal surface side of the fluorescent film and thereafter a film of Al or the like is deposited thereon.

The face plate 86 may also be provided with a transparent electrode (not illustrated) on the external surface side (on the glass substrate 83 side) of the fluorescent film 84 in order to enhance the conductive property of the fluorescent film 84.

On the occasion of execution of the aforementioned sealing, sufficient alignment is indispensable in the color case, because the fluorescent areas of the respective colors need to be positioned in correspondence to the associated electron emitting elements.

The image forming apparatus shown in FIG. 15 is fabricated, for example, in the following manner. The enclosure 88 is evacuated through an unillustrated exhaust pipe by an evacuating device not using oil, such as the ion pump or the absorption pump, while being heated, if necessary, in the same manner as in the aforementioned stabilization step; the enclosure is sealed after the ambience reaches one with sufficiently decreased organic substance in the vacuum of about $10^{-7}$ Torr. A getter process can also be applied in order to maintain the degree of vacuum after the sealing of the enclosure 88. This getter process is a process for forming an evaporated film by heating a getter located at a predetermined position (not illustrated) in the enclosure 88 by heat generated by resistance heating or high-frequency heating immediately before the sealing of the enclosure 88 or after the sealing. The principal component of the getter is normally Ba etc., and the vacuum of $1\times10^{-5}$ to $1\times10^{-7}$ [Torr] is maintained by adsorbing action of the evaporated film, for example.

Next described referring to FIG. 17 is a configuration example of the driving circuit for TV display based on the TV signals of the NTSC method on the display panel constructed using the electron source of the single matrix configuration. In FIG. 17, numeral 101 denotes an image display panel, 102 a scanning circuit, 103 a controlling circuit, and 104 a shift register. Numeral 105 represents a line memory, 106 a synchronizing signal separating circuit, 107 a modulation signal generator, and Vx and Va dc voltage supplies.

The display panel 101 is connected to the external electric circuits through terminals Dox1 to Doxm, terminals Doy1 to Doyn, and a high voltage terminal Hv. Applied to the terminals Dox1 to Doxm are scan signals for successively driving the electron source disposed inside the display panel, i.e., the surface conduction type electron emitting element group of the matrix wire configuration of M rows×N columns line by line (N elements).

Applied to the terminals Doy1 to Doyn are modulation signals for controlling output electron beams of the respective elements in one row of surface conduction type electron emitting elements selected by a scan signal described above. A dc voltage of 10 K[V], for example, is supplied from dc voltage supply Va to the high voltage terminal Hv and this voltage is an acceleration voltage for imparting sufficient energy for excitation of the fluorescent substance to the electron beams emitted from the surface conduction type electron emitting elements.

The scanning circuit 102 will be described below. This circuit has M switching elements inside (schematically shown by S1 to Sm in the drawing). Each switching element selects either one of the output voltage from dc voltage supply Vx or 0 [V] (the ground level) to be electrically coupled with the terminal Dox1 to Doxm of the display panel 101. The switching elements of S1 to Sm operate based on a control signal Tscan outputted from the controlling circuit 103 and are constructed of a combination of switching devices such as FETs, for example.

The dc voltage supply Vx in this example is set so as to output such a constant voltage that the driving voltage applied to the unscanned elements is not more than an electron emission threshold voltage, based on the characteristics (the electron emission threshold voltage) of the surface conduction type electron emitting elements.

The controlling circuit 103 has a function to match operations of the respective sections with each other so as to achieve appropriate display based on the image signals supplied from the outside. The controlling circuit 103 generates and sends each control signal of Tscan, Tsft, and Tmry to each section, based on the synchronizing signal Tsync sent from the synchronizing signal separating circuit 106.

The synchronizing signal separating circuit 106 is a circuit for separating synchronizing signal components and luminance signal components out of the TV signals of the NTSC method supplied from the outside, which can be constructed using an ordinary frequency separation (filter) circuit or the like. The synchronizing signals separated by the synchronizing signal separating circuit 106 consist of vertical synchronizing signal and horizontal synchronizing signal, but they are illustrated as Tsync signal for convenience' sake of explanation. The luminance signal components of image separated from the TV signals are denoted by DATA signals for convenience' sake. The DATA signals are supplied to the shift register 104.

The shift register 104 is provided for serial-parallel conversion line by line of image to convert the DATA signals serially supplied in time series to parallel signals. The shift register 104 operates based on the control signal Tsft sent from the controlling circuit 103 (which means that the control signal Tsft can also be said as shift clocks of the shift register 104). The data of one line of image (corresponding to driving data for N electron emitting elements) after the serial-parallel conversion is outputted as N parallel signals of Id1 to Idn from the shift register 104.

The line memory 105 is a storage device for storing data of one line of image during a desired period. The line memory 105 properly stores the contents of Id1 to Idn according to the control signal Tmry supplied from the controlling circuit 103. The stored contents are outputted as Id'1 to Id'n to be supplied to the modulation signal generator 107.

The modulation signal generator 107 is a signal source for properly driving and modulating each of the surface conduction type electron emitting elements according to each of the image data Id'1 to Id'n, and the output signals therefrom are applied to the surface conduction type electron emitting elements in the display panel 101 through the terminals Doy1 to Doyn.

The electron emitting elements according to the present invention have the following fundamental characteristics as to the emission current Ie. Namely, there is a definite threshold voltage Vth for emission of electron, and emission of electron occurs only when the voltage of not less than Vth is applied. With increasing voltages over the electron emission threshold value, the emission current also varies according to change in the applied voltage to the element. This tells us that when the voltage of the pulse shape is applied to the elements, emission of electron does not occur with application of the voltage below the electron emission threshold value, for example, but an electron beam is outputted with application of the voltage not less than the electron emission threshold value. On that occasion, the strength of the output electron beam can be controlled by changing the peak value Vm of pulse. The total amount of charge of the output electron beam can be controlled by changing the pulse width Pw. Therefore, the method for modulating the electron emitting elements can be selected from the voltage modulating method, the pulse width modulating method, and so on, depending upon the input signal. For carrying out the voltage modulation method, the modulation signal generator 107 can be a circuit of the voltage modulation method arranged to generate voltage pulses of a constant length and to properly modulate peak values of pulses according to the input data.

For carrying out the pulse width modulating method, the modulation signal generator 107 can be a circuit of the pulse width modulating method arranged to generate voltage pulses of a constant peak value and to properly modulate widths of voltage pulses according to the input data.

The shift register 104 and the line memory 105 can be those of the digital signal type or the analog signal type, because only an essential point is to carry out the serial-parallel conversion and storage of image signals at predetermined speed.

When they are of the digital signal type, the output signals DATA from the synchronizing signal separating circuit 106 need to be converted to digital signals and this is achieved simply by providing an A/D converter at the output part of 106. In connection with this, there is a small difference in the circuitry used in the modulation signal generator 107, depending upon whether the output signals from the line memory 105 are digital signals or analog signals. In the case of the voltage modulating method using the digital signals, the modulation signal generator 107 is, for example, a D/A converting circuit and an amplifying circuit is added if necessary. .In the case of the pulse width modulating method, the modulation signal generator 107 is a circuit as a combination of a high-speed oscillator, a counter for counting waves outputted from the oscillator, and a comparator for comparing an output value from the counter with an output value from the memory, for example. In addition, the circuit may also be provided with an amplifier for amplifying a pulse-width-modulated modulation signal outputted from the comparator up to the driving voltage of the surface conduction type electron emitting elements, if necessary.

In the case of the voltage modulating method using the analog signals, the modulation signal generator 107 can be an amplifying circuit using an operation amplifier, for example, and a level shift circuit or the like can be added if necessary. In the case of the pulse width modulating method, for example, a voltage-controlled oscillator (VCO) can be employed, and an amplifier for amplifying the voltage up to the driving voltage of the surface conduction type electron emitting elements can also be added if necessary.

In the image display apparatus of this configuration, when the voltage is applied to each electron emitting element through the terminals Dox1 to Doxm and Doy1 to Doyn outside the package, the emission of electron occurs. The electron beams are accelerated by applying the high voltage to the metal back 85 or to the transparent electrode (not illustrated) through the high voltage terminal Hv. The accelerated electrons collide with the fluorescent film 84 to generate fluorescence therein, thus forming an image.

The structure of the image forming apparatus described herein is just an example, and it is noted that a variety of modifications can be made based on the technical concept of the present invention. The input signals were those of the NTSC method, but the input signals are not limited to these. For example, the input signals can also be of the PAL method, the SECAM method, or a method of TV signals consisting of more scan lines (for example, the high-definition TV method including the MUSE method).

The electron source and image forming apparatus of the ladder configuration will be described below referring to FIG. 18.

Figure 18:
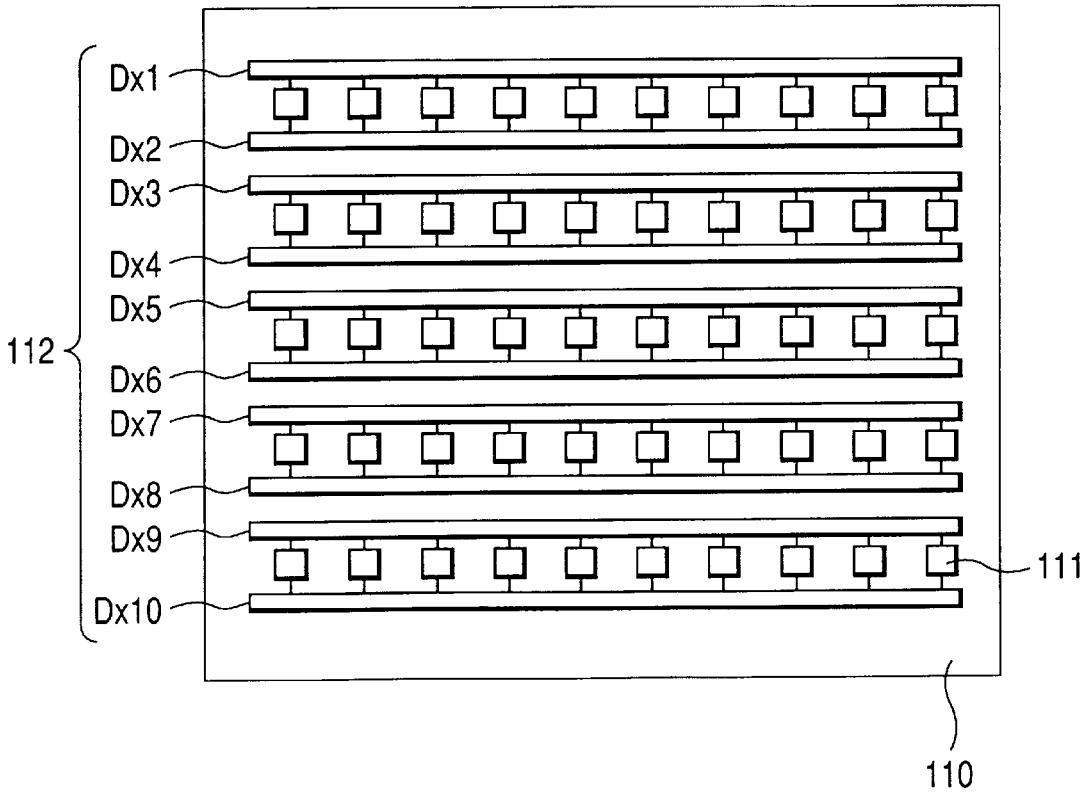
FIG. 18 is a schematic view to show an electron source substrate constructed of ladder type wires, which can be employed in the present invention.

FIG. 18 is a schematic diagram to show an example of the electron source of the ladder configuration. In FIG. 18, numeral 110 designates an electron source substrate and 111 electron emitting elements. Numeral 112 (D×1 to D×10) are common wires for connecting the electron emitting elements 111. A plurality of electron emitting elements 111 are aligned in parallel in the X-direction on the substrate 110 (as will be called element rows). A plurality of such element rows are arranged to compose the electron source. When the driving voltage is placed between the common wires of each element row, each of the element rows can be driven independently of each other. Namely, the voltage over the electron emission threshold value is applied to the element rows desired to emit the electron beam and the voltage below the electron emission threshold value is applied to the element rows not desired to emit the electron beam. The common wires D×2 to D×9 between the element rows can be combined; for example, the wires D×2 and D×3 can be made as a single wire. The image forming apparatus can be constructed using this electron source in the same manner as that described referring to FIG. 15.

EXAMPLES

The present invention will be described in further detail with examples thereof.

Example 1

Figure 2:
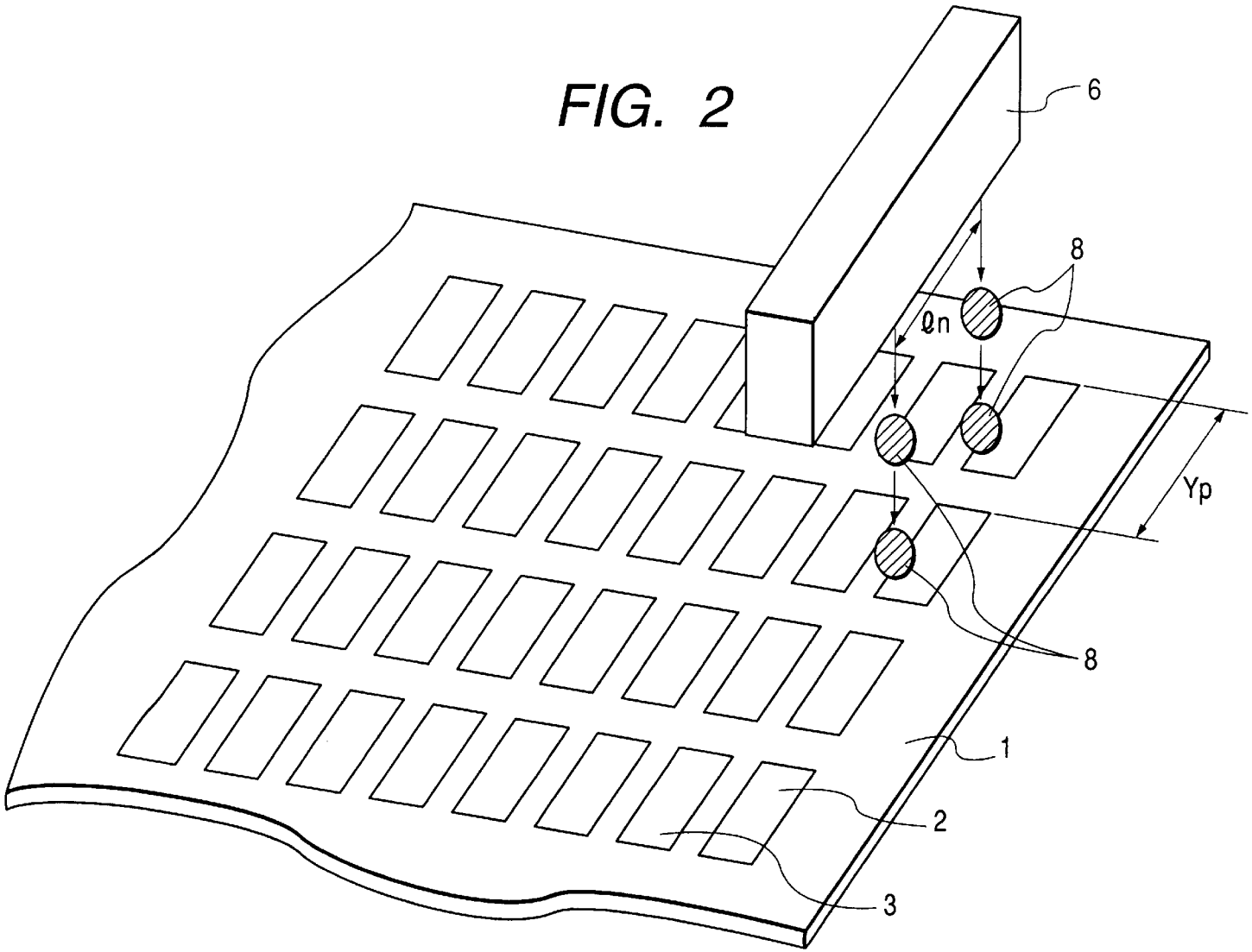
FIG. 2 is a schematic structural diagram to enlargingly show a part of the head and element portion in the circle of FIG. 1.
Figure 3:
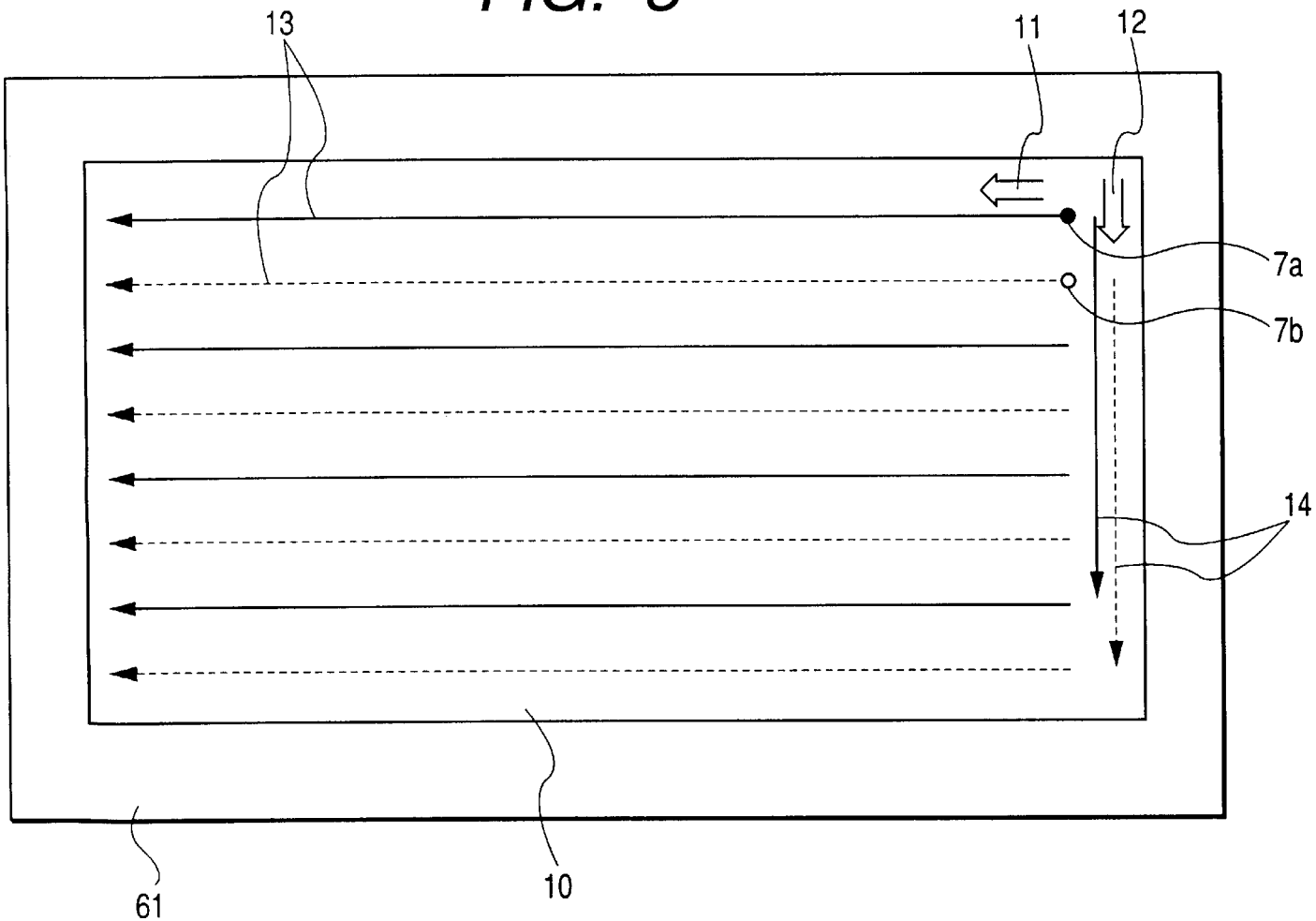
FIG. 3 is a schematic diagram to show a droplet dispensing way with plural nozzles in the first embodiment of the present invention.
Figure 4:
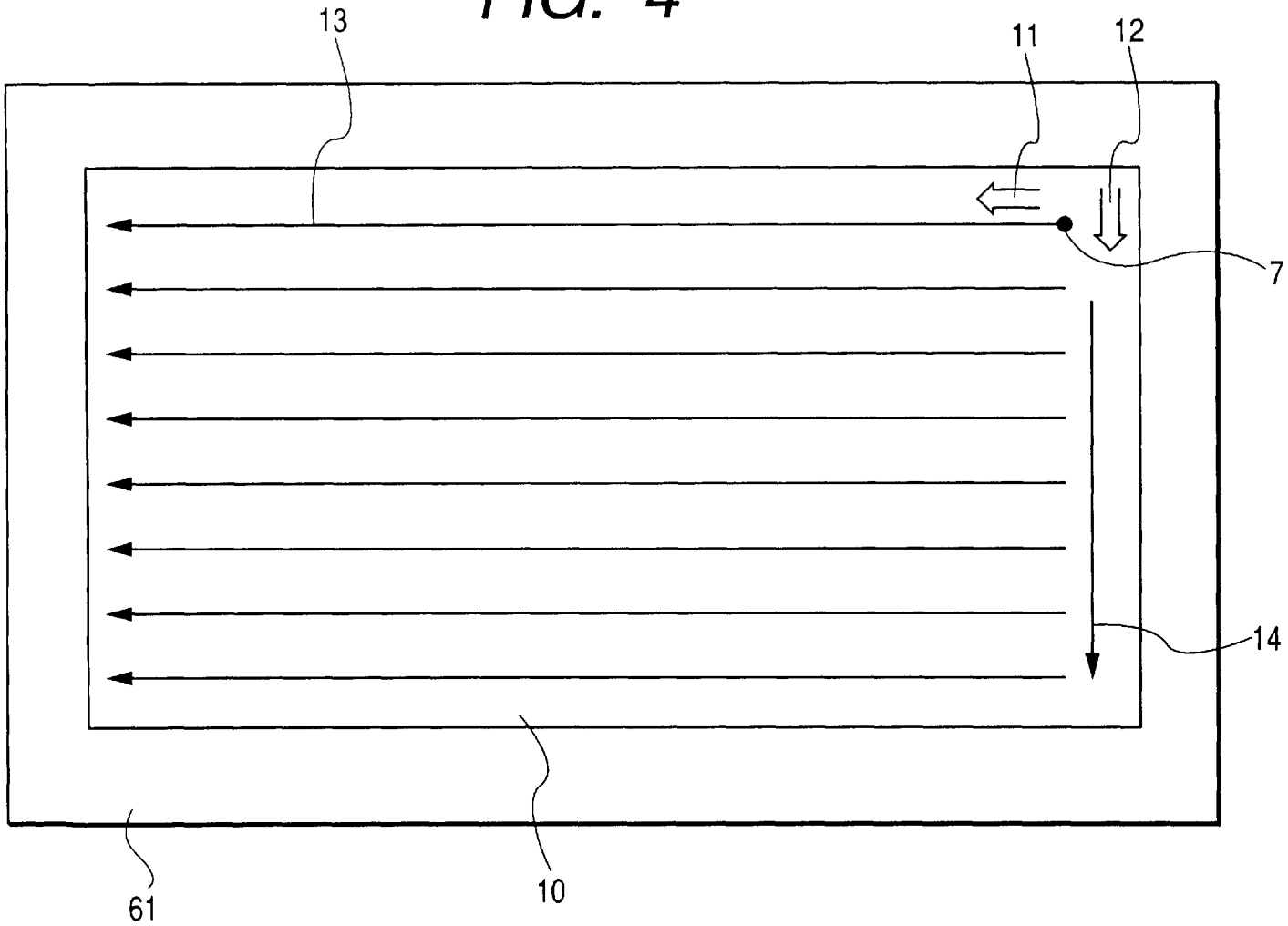
FIG. 4 is a schematic diagram to show a droplet dispensing way with a single conventional nozzle.

FIG. 1 is a drawing to best show the feature of the present invention, which is a diagram to illustrate a method for producing elements of an electron source substrate, using a plurality of nozzles of an ink jet device. FIG. 2 is an enlarged view of the area inside the circle of FIG. 1, which is a schematic view to enlargingly illustrate the positional relation between the ink jet device 6 and the element electrodes 2, 3, and dispensing states of droplets from the respective nozzles. FIGS. 3 and 4 are schematic diagrams for explaining the relative movement of each nozzle of the ink jet device 6 to the substrate 61 in the dispensing operation of droplet.

The method for producing the electron source substrate will be described in order, mainly using FIGS. 1, 2, 3, and 4 noted above. In the present example, first, the number of nozzles used for dispensing of droplet is two. As shown in FIG. 1, on stage 9 there is an electron source substrate 61 with the conductive thin film being not formed yet. Numeral 10 denotes an area for electron emitting elements, to which droplets 8 are to be dispensed with the two nozzles.

The surface conduction type electron emitting devices on the electron source substrate 61 are the same as those described in the embodiments, and each single element is the same as that shown in FIGS. 10A and 10B and is composed of the substrate 1, element electrodes 2, 3, and conductive thin film (fine particle film) 4. This electron source substrate 61 also has wire electrodes not illustrated in FIG. 2.

Figure 6:
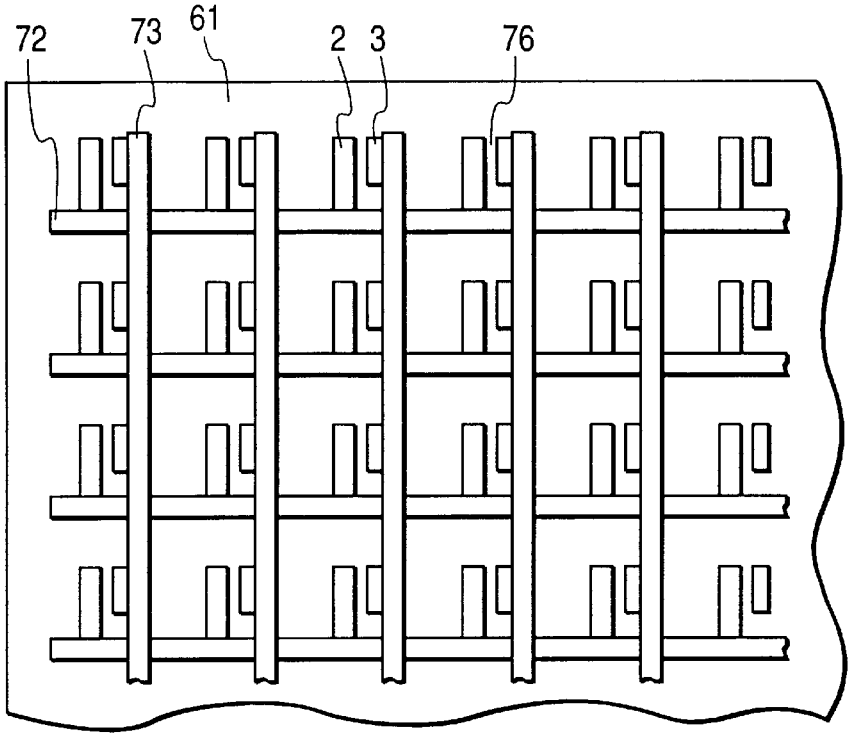
FIG. 6 is a schematic diagram to show an electron source substrate of a matrix configuration type that can be applied to the present invention.

An example of production of this electron source substrate will be described briefly. First, a glass substrate was used as an insulating substrate. This was fully washed with an organic solvent or the like and then was dried in a drying furnace at 120° C. A film of Pt (the thickness 500 Å) was deposited on this substrate to form paired element electrodes having the electrode width 500 $\mu$m and the electrode gap distance 20 $\mu$m in a row and column pattern of 500 rows and 1500 columns, totally 75000 pairs, and wires were connected to the respective electrodes. The wires employed were those of the matrix configuration as shown in FIG. 6.

The source liquid for droplets was an aqueous-solution-based one; specifically, an aqueous solution of palladium acetate-ethanolamine complex which was an aqueous solution having the composition of 0.05 wt % polyvinyl alcohol, 15 wt % 2-propanol, 1 wt % ethylene glycol, and 0.15 wt % palladium acetate-ethanolamine complex ($Pd(NH_2CH_2CH_2OH)_4(CH_3COO)_2$) based on the concentration of palladium by weight, dissolved in water. The ink jet device was one of the piezo jet method for discharging the liquid by use of the piezoelectric device. Using the aqueous solution and the ink jet device stated above, the droplet dispensing operations were carried out. Now, let us explain the method for dispensing droplets to the electron emission area by use of the two nozzles of the ink jet device, referring to FIG. 3 and FIG. 4.

Figure 5A:
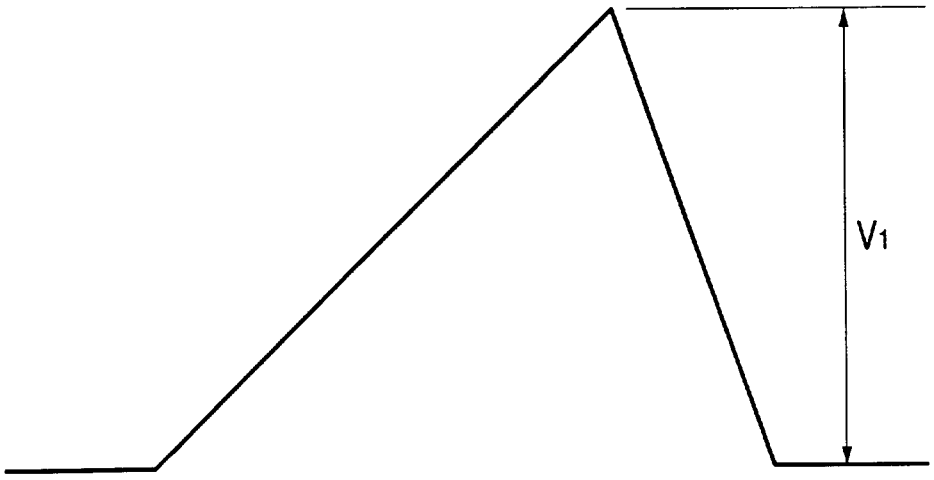
FIGS. 5A and 5B are drawings to show examples of driving pulses applied to each nozzle of an ink jet device.

First, the two nozzles 7*a*, 7*b* of the ink jet device for dispensing droplets to the electron emission area 10 were activated to dispense the droplet by a constant driving pulse (the pulse height of V1 volt) as shown in FIG. 5A, and delivery amounts of the nozzles were detected. The detection of delivery amounts was conducted by a method for dispensing a droplet onto an electrode pair, thereafter baking it to form the conductive thin film, and measuring a resistance thereof. The electrode pairs used were the element electrode pairs on the substrate at the time when the element electrodes have been made on the same substrate as that used in this example, but they may be any electrode pairs by that the resistances of conductive thin film can be evaluated and compared. In the present example the resistance of the conductive thin film formed by each nozzle was determined as follows; four droplets were dispensed from each nozzle to one electrode pair, they were baked to form the conductive thin film, resistances of conductive thin film areas of ten elements were measured, and an average of the resistances was defined as a resistance of the conductive thin film formed by that nozzle.

Figure 5B:
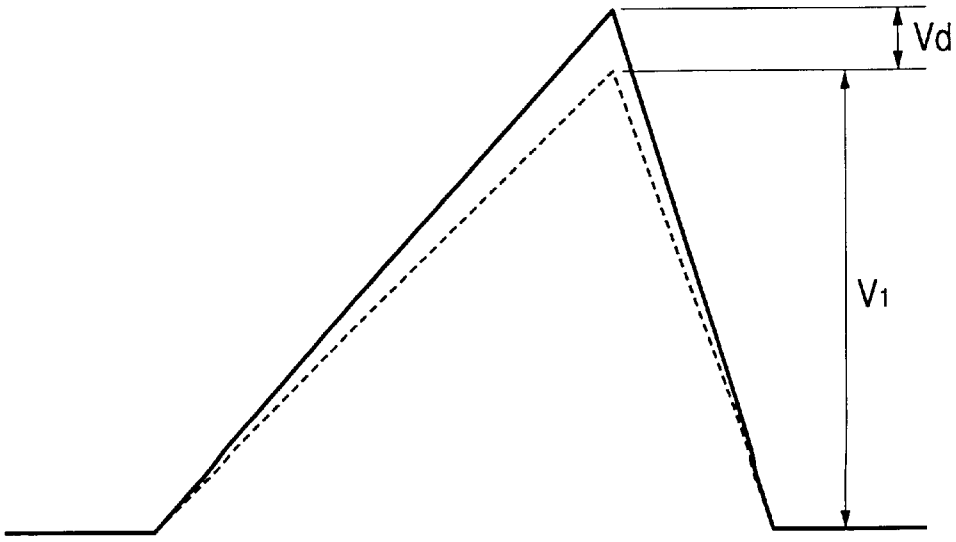

The resistances to indicate the delivery amounts of the respective nozzles, measured at this time, were as follows; the resistance of the conductive thin film formed by the nozzle 7*a* was 3.1 kΩ; the resistance of the conductive thin film formed by the nozzle 7*b* was 3.4 kΩ; there was thus the difference of 0.3 kΩ between the resistances of the conductive thin films. Then the voltage of the driving pulse of nozzle 7*b* was increased by Vd volt so as to make the delivery amount of nozzle 2 equal to that of nozzle 1. After this adjustment, dispensing operations of droplet were carried out from the nozzle 7*b* by the driving pulse as shown in FIG. 5B, so that the resistance of the conductive thin film formed by the nozzle 2 became 3.1 kΩ.

Since the piezo jet method permits the displacement amount of piezoelectric device to be changed readily by control of the driving pulse applied thereto, adjustment of delivery amount was also easy.

Subsequently, the dispensing operations of droplets to the electron emission area were conducted in such manner that the droplets were dispensed to each of the element portions of the element area 10 while the two nozzles 7*a*, 7*b*, first at the right upper of the element area, were moved relative to the substrate 61 in the X-direction 11 and in the Y-direction 12 (FIG. 3). The same relative movement in the X-direction was repetitively carried out four times to dispense totally four droplets over a gap portion of each pair of element electrodes in superimposed manner. The distance ln between the two nozzles 7*a*, 7*b* was made equal to the Y-directional pitch Yp of the element string (FIG. 2). The relative movement of the nozzles to the substrate was conducted so that driving speeds and driving distances of the two nozzles were equal both in the X-direction 11 and in the Y-direction 12. This can be realized either by driving the ink jet device having the nozzles (i.e., the head) or by driving the stage on the substrate side. In this example the ink jet device (the head) was fixed, while the substrate side was driven (FIG. 3). Alternatively, the dispensing operations of droplet can also be made by setting the distance between the two nozzles equal to the X-directional pitch of the element string and performing the relative movement in the X-direction and in the Y-direction, flipped from that in the above example.

The arrows in FIG. 3 indicate patterns of the relative movement of the respective nozzles, in which numeral 13 denotes X-directional driving strokes and 14 Y-directional driving strokes. In the drawing the movement pattern of the nozzle 7*a* was indicated by solid lines, while the movement pattern of the nozzle 7*b* by dashed lines. In comparison with a pattern of relative movement where droplets were dispensed from one nozzle to the substrate having the same electron emission area 10 as shown in FIG. 4, the present example made it possible to dispense the droplets to the entire surface of the electron emission area by an amount of relative movement being a half of the X-directional relative movement amount per nozzle in the case of the single nozzle for dispensing, because the two nozzles were used to separately perform the dispensing operations of droplets to the area of electron emission elements. Supposing the driving speeds of relative movement during dispensing were equal, it became possible to perform the dispensing operations in a period equal to approximately a half of that in the case of the single nozzle.

After dispensing of droplet, the substrate was heated in the baking furnace at 350° C. for 20 minutes to remove organic components, thereby forming the conductive thin film of fine particles of palladium oxide (PdO) in the element electrode portions. conductive thin film after baking had the diameter of the disk shape of about 100 $\mu$m and the thickness of 150 Å. The element length was about 100 $\mu$m. Since the driving pulses for the respective nozzles were set so as to eliminate the difference between the delivery amounts of the two nozzles of the ink jet device for dispensing the droplets to the electron emission area, dispersion was small in the diameter and the thickness of conductive thin film throughout the entire surface of substrate.

Figure 22:
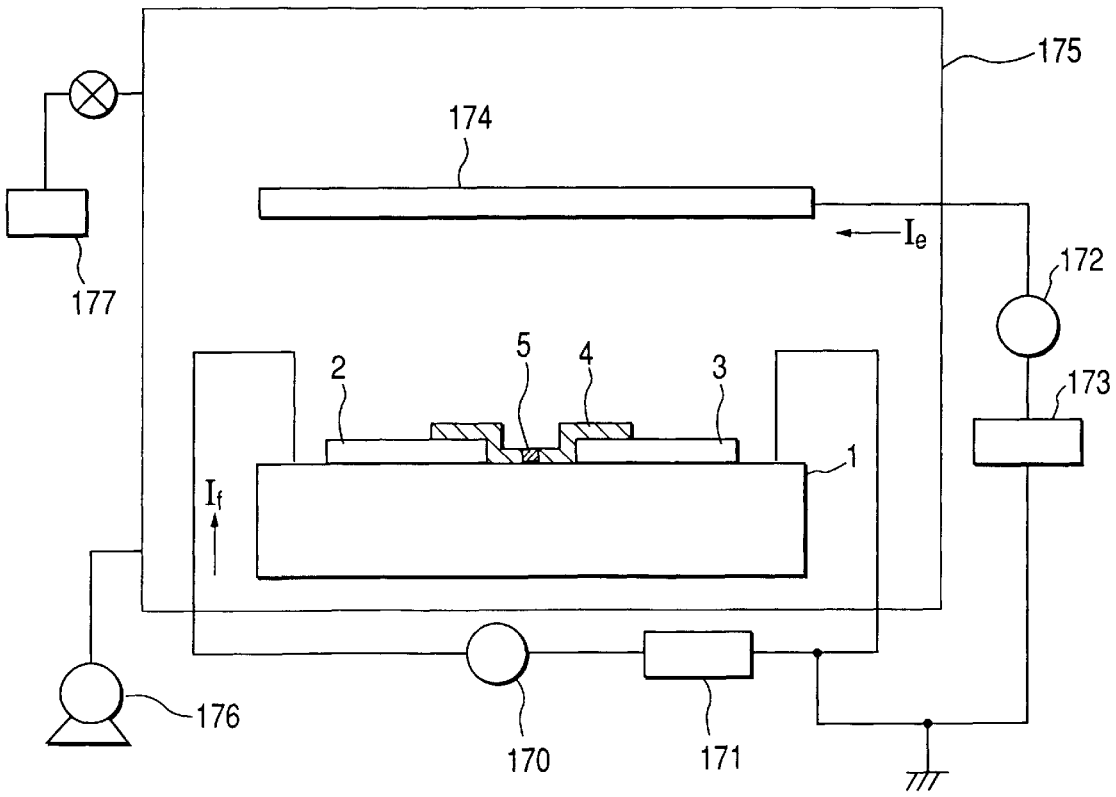
FIG. 22 shows a vacuum processing apparatus used in the first embodiment of the present invention.

Next, the substrate on which a conductive film 4 of the present embodiment is formed is provided within a vacuum processing apparatus shown in FIG. 22. And, the apparatus is evacuated into $20^{-8}$ Torr by a vacuum pump.

With regard to the vacuum processing apparatus shown in FIG. 22, an explanation is made as follow. FIG. 22 shows schematically an example of the vacuum processing apparatus can perform a forming processing, an activation processing and a stabilizing processing. Wherein, a wiring etc., are omitted in the drawing. Also, in FIG. 22, the same portions as in FIG. 10 are denoted by the same reference numerals as in FIG. 10. Referring to FIG. 22, 175 denotes a vacuum container, and 176 a exhaust pump. Within the vacuum container 175, the electron emission elements are arranged. That is, 1 denotes a substrate constituting the electron emission elements, 2 and 3 element electrodes, 4 a conductive thin film, and 5 an electron emitting section, 171 denotes a power source for applying an element voltage Vf to the electron emission elements, 170 a current meter for measuring an element current $I_f$ flowing through the conductive thin film 4 between the element electrodes 2 and 3, 174 an anode electrode for trapping emission current $I_e$ emitted from the electron emitting sections of the elements, 173 a high voltage power source for applying a voltage to the anode electrode 174, 172 a current meter for measuring the emission current $I_e$ emitted from the electron emitting section 5, and 177 a source for producing an organic gas for use in the activation process. The exhaust pump 176 comprises a super high vacuum apparatus system comprising a turbo pump, a dry pump, an ion pump etc.

Whole of the vacuum processing apparatus in which the electron source substrate is arranged can be heated into 350° C. by a heater not shown in the drawings.

Within the vacuum processing apparatus shown in FIG. 22 described in the above, the forming processing is performed. Electrically energization for conducting between the element electrodes 2 and 3, at a section of the conductive thin film 4, a fissure is formed. A voltage waveform of the energization forming is a pulse waveform. The voltage pulse waveform of step shape raising from 0 volt to 0.1 volt is applied. A voltage waveform is a rectangular wave with a pulse width of 1 msec and a pulse interval of 10 msec. The energization forming processing is terminated when the conductive thin film has a resistance 1MΩ or more.

Figure 23:
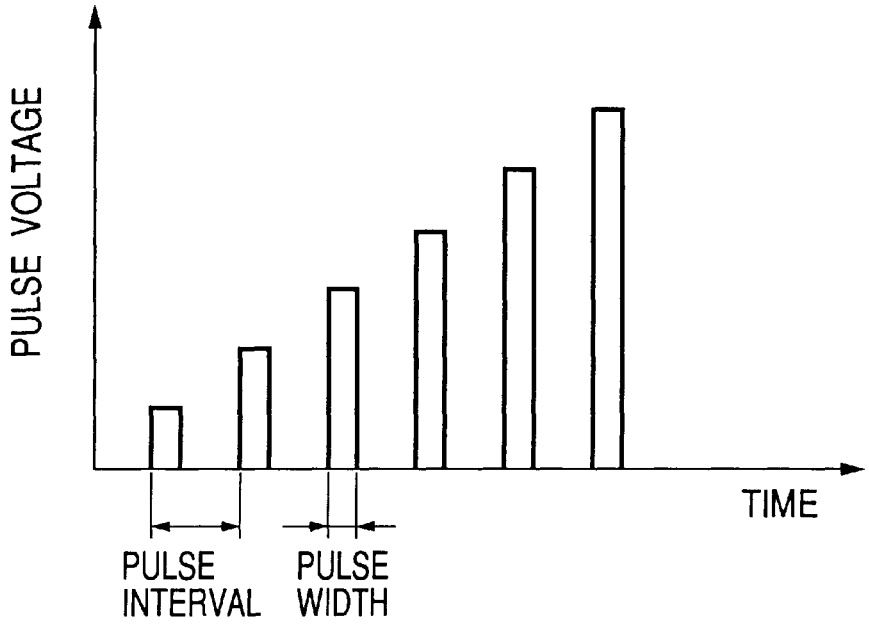
FIG. 23 shows an energization forming waveform used in the first embodiment.

FIG. 23 shows the forming waveform used in the present embodiment. One of the element electrodes 2 and 3 is set at a lower voltage, while the other is set at a higher voltage.

The element after the forming processing is subjected to the activation processing. The activation processing forms a carbon or a carbon compound, and changes the element current $I_f$ and the emission current Ie significantly.

In the activation processing, an acetone gas is introduced by $10^{-3}$ Torr, and a pulse of a square waveform with a pulse hight 15V, pulse width 1 msec and pulse interval 10 msec is applied for 20 minutes.

Figure 24:
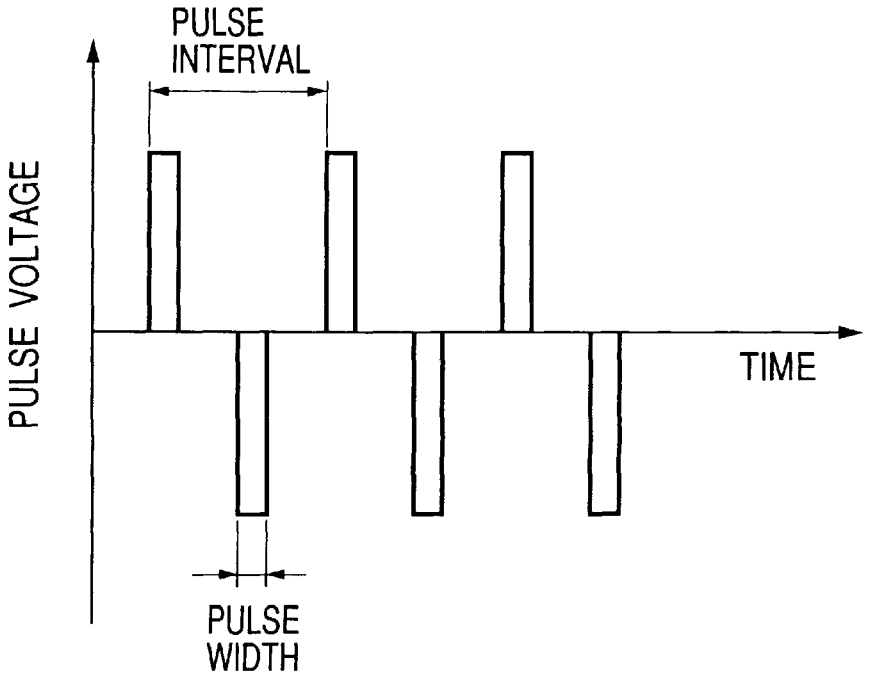
FIG. 24 shows a pulse waveform used in the activation process in the first embodiment.

FIG. 24 shows a pulse waveform used in the activation process. According to the present embodiment, the element electrodes 2 and 3 are supplied with alternatingly low and high voltages in pulse interval.

And then, the stabilizing process is performed. In the stabilizing process, the organic gas in the atmosphere within the vacuum container is exhausted. A deposition of the carbon and the carbon compound is limited. And, the element current $I_f$ and the emitting current Ie are stabilized. The vacuum container is heated wholy at 250° C., and the organic molecule absorbed at an inner wall of the vacuum container and the electron emission elements is exhausted.

Thus, the electron emitting source substrate provided with the surface conduction type electron emission elements group is completed.

In the case where the adjustment was not carried out for the delivery amounts of the nozzle 7*a* and nozzle 7*b* and the droplets were dispensed by the same driving pulse shown in FIG. 5A to the two nozzles, the dispersion in the resistance of conductive thin film was as follows; with 32500 elements produced by the nozzle 7*a*, the average resistance was 3.1 kΩ and the coefficient of variation (standard deviation/average) was 5.0%; with 32500 elements produced by the nozzle 7*b*, the average resistance was 3.4 kΩ and the coefficient of variation (standard deviation/average) was 5.2%; with 75000 elements on the entire surface of substrate, the average resistance was 3.25 kΩ and the coefficient of variation (standard deviation/average) was 7.5%. In contrast with it, the present example exhibited the following results; with 32500 elements produced by the nozzle 7*a*, the average resistance was 3.1 kΩ and the coefficient of variation (standard deviation/average) indicating the degree of dispersion was 5.0%; with 32500 elements produced by the nozzle 7*b*, the average resistance was 3.1 kΩ and the coefficient of variation (standard deviation/average) was 5.2%; with 75000 elements on the entire surface of substrate, the average resistance was 3.1 kΩ and the coefficient of variation (standard deviation/average) was 5.1%. The dispersion in electron emission amounts in the form of the electron source substrate was 9.0% in the case without the adjustment of delivery amount, but it was 5.8% in the present example. Therefore, the present example had smaller dispersion both in the resistance of conductive thin film and in the electron emission amounts.

The large-area electron source substrate produced by the method shown in Example 1 above achieved good electron emission characteristics while well suppressing the dispersion in the electron emission characteristics among the elements.

Example 2

Figure 7:
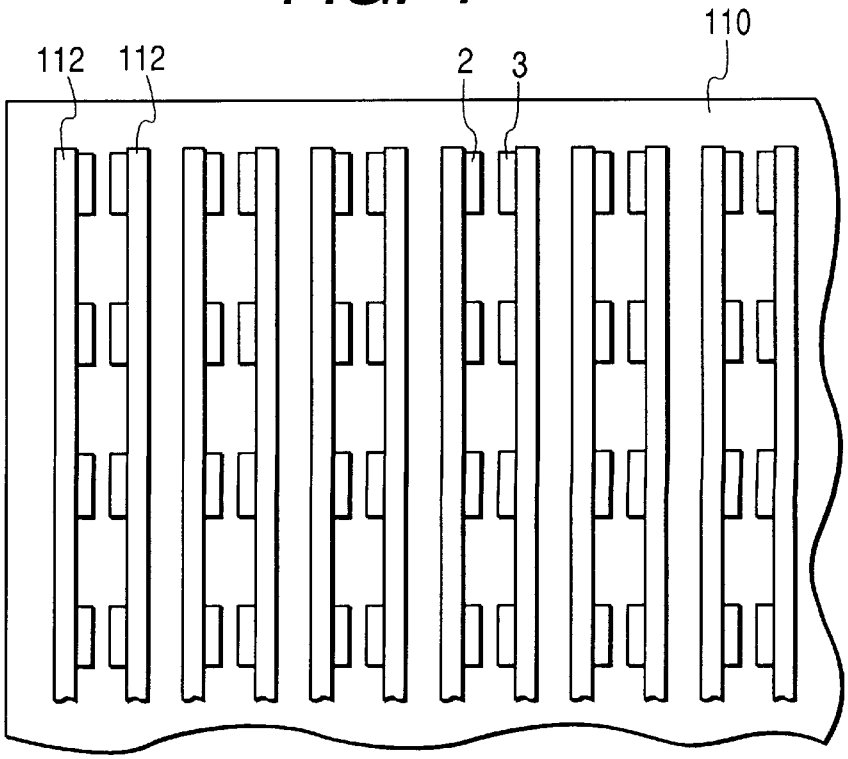
FIG. 7 is a schematic diagram to show an electron source substrate of a ladder configuration type that can be applied to the present invention.

Described below as Example 2 is an example of production of an image forming apparatus having the surface conduction type electron emitting elements by the production method of the present invention. In the present example paired electrodes were arranged in a column and row pattern of 500 rows×1500 columns, totally 75000 pairs, and the electrodes were connected in a ladder pattern with wires, as shown in FIG. 7.

In this example of production of the surface conduction type electron emitting elements, the basic idea is exactly the same as in Example 1, but the number of nozzles used for dispensing of droplet was four. The source liquid for droplet was an organic-solvent-based solution; specifically, a butyl acetate solution of palladium acetate-bisdipropylamine complex. The ink jet device was of the piezo jet method for dispensing the solution by use of the piezoelectric device.

With the four nozzles of the ink jet device for dispensing the droplets to the electron emission area, they were activated to dispense the droplets by the constant driving pulse in the same manner as in Example 1, and delivery amounts thereof were detected. In the present example the method for detecting the delivery amounts was a method for measuring a delivery amount per droplet by measuring how many droplets are necessary for dispensing a constant amount of liquid from each nozzle.

Specifically, fine tubes, whose volume (capacity) per unit length was preliminarily measured, were prepared and were installed as a part of ink supply path to the head (nozzles). A marker (for example, a bubble) was introduced into each fine tube on the occasion of supply of ink. Dispensing operations of droplet were carried out from the nozzles at constant frequency and the time was measured before the marker moved a constant distance. In the present example the fine tubes were those of glass having the volume (capacity) per 100 mm of 30 μl (300 nl/mm) and measurement was conducted at the discharge frequency 1000 Hz. In this case, for example, supposing 600 seconds are needed for movement across 100 mm, 600000 droplets will amount to 30 μl, and thus an amount per droplet is 50 μl.

In the present example, the delivery amounts from the four nozzles 7*a* to 7*d* were as follows; the nozzle 7*a* 50 pl; the nozzle 7*b* 48 pl; the nozzle 7*c* 51 pl; the nozzle 7*d* 49 pl. The voltage of driving pulse was adjusted for each nozzle so that the delivery amount of nozzle 7*b*–7*d* became 50 pl. This adjustment made the nozzles 7*b* to 7*d* discharge the same amount of droplet as the nozzle 7*a*.

Figure 8:
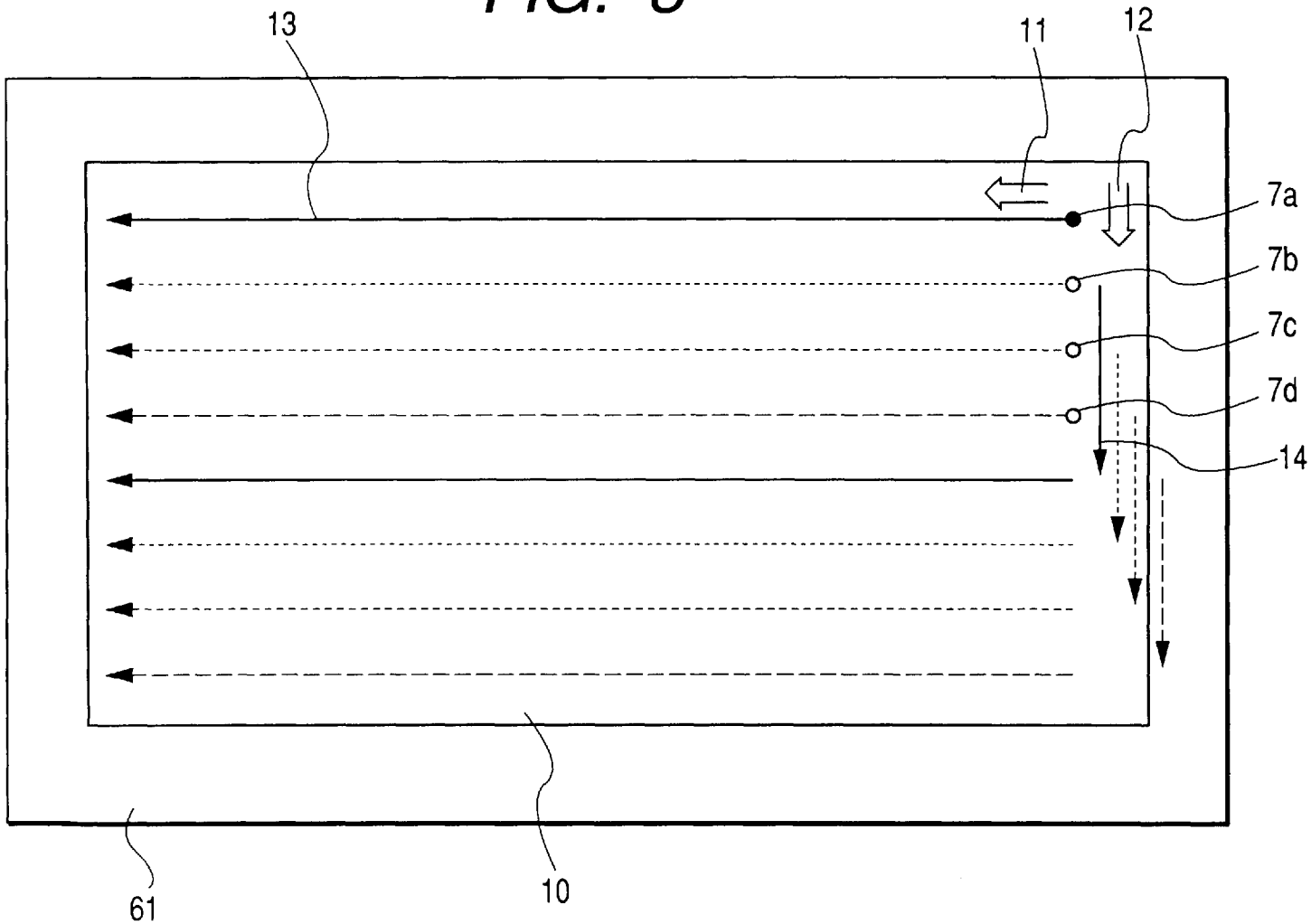
FIG. 8 is a schematic diagram to show a droplet dispensing way with plural nozzles in a second embodiment of the present invention.

Subsequently, the dispensing operations of droplets were carried out to the electron emission area in such manner that, as shown in FIG. 8, the droplets were dispensed to each element portion in the element area 10 by relatively moving the nozzles 7*a* to 7*d*, first at the right upper of the element area, relative to the substrate 61 in the X-direction 11 and in the Y-direction 12. The distance between the four nozzles was also the same as the Y-directional pitch of the element string. The relative movement between the nozzles and the substrate was carried out so that the driving speeds and driving distances of the four nozzles are the same both in the X-direction 11 and in the Y-direction 12. In the present example the head side was fixed, while the substrate side was driven.

The arrows in FIG. 8 indicate patterns of relative movement of the respective nozzles. Numeral 13 represents X-directional driving strokes and 14 Y-directional driving strokes. An amount of X-directional relative movement per nozzle was a quarter of that in the case of dispensing of droplet with a single nozzle. Supposing the driving speeds of the relative movement during dispensing were equal, it became possible to perform the process in a period being about a quarter of that in the case with a single nozzle.

Four droplets were successively dispensed to each gap portion between the element.electrodes in superimposed manner as in Example 1. On this occasion, the dispensing intervals of droplets to each element were the same as in Example 1. After dispensing of droplet, the substrate was heated in the baking furnace at 350° C. for 20 minutes to remove the organic components, thereby forming the conductive thin film of fine particles of palladium oxide (PdO) in the element electrode portions. The conductive thin film after baked had the diameter of the circle of about 100 μm and the thickness of 150 Å. The element length was about 100 μm. Since the driving pulses were set for the respective nozzles so as to suppress the differences among the delivery amounts of the four nozzles of the ink jet device for dispensing the droplets to the electron emission area, the dispersion was small in the diameter and the thickness of conductive thin film throughout the entire surface of substrate.

Further, the voltage was placed between the element electrodes 2, 3 where the conductive thin film was formed, so as to effect the electric forming process or the like on the conductive thin film to form the electron emitting portions, further to perform an activation process thus completing the electron source substrate having the surface conduction type electron emitting element group.

This electron source substrate was housed in the enclosure comprised of the face plate 86, support frame 82, and rear plate 81 as shown in FIG. 15. Next, a stabilization process is performed for vacuum sealing. After that, an image forming apparatus was produced with the driving circuit for television display based on the television signals of the NTSC method as shown in FIG. 17.

The coefficient of variation (standard deviation/average), indicating the dispersion in luminance of the image forming apparatus of the present example, was 3.0%, which was smaller than 7.0% in the case where the apparatus was produced without correction for the differences in the delivery amounts among the nozzles.

The large-area image forming apparatus produced by the method described in Example 2 above achieved good quality of image with less dispersion in luminance.

Example 3

Described below as Example 3 is an example of production of an electron source substrate having the surface conduction type electron emitting elements by the production method of the present invention. In the present example, the electrodes were arranged in the row and column pattern as in FIG. 6, the electrodes were connected in the matrix pattern with wires, the size of the substrate was approximately double that in Example 1, and the electron emission area was twice larger.

Figure 9:
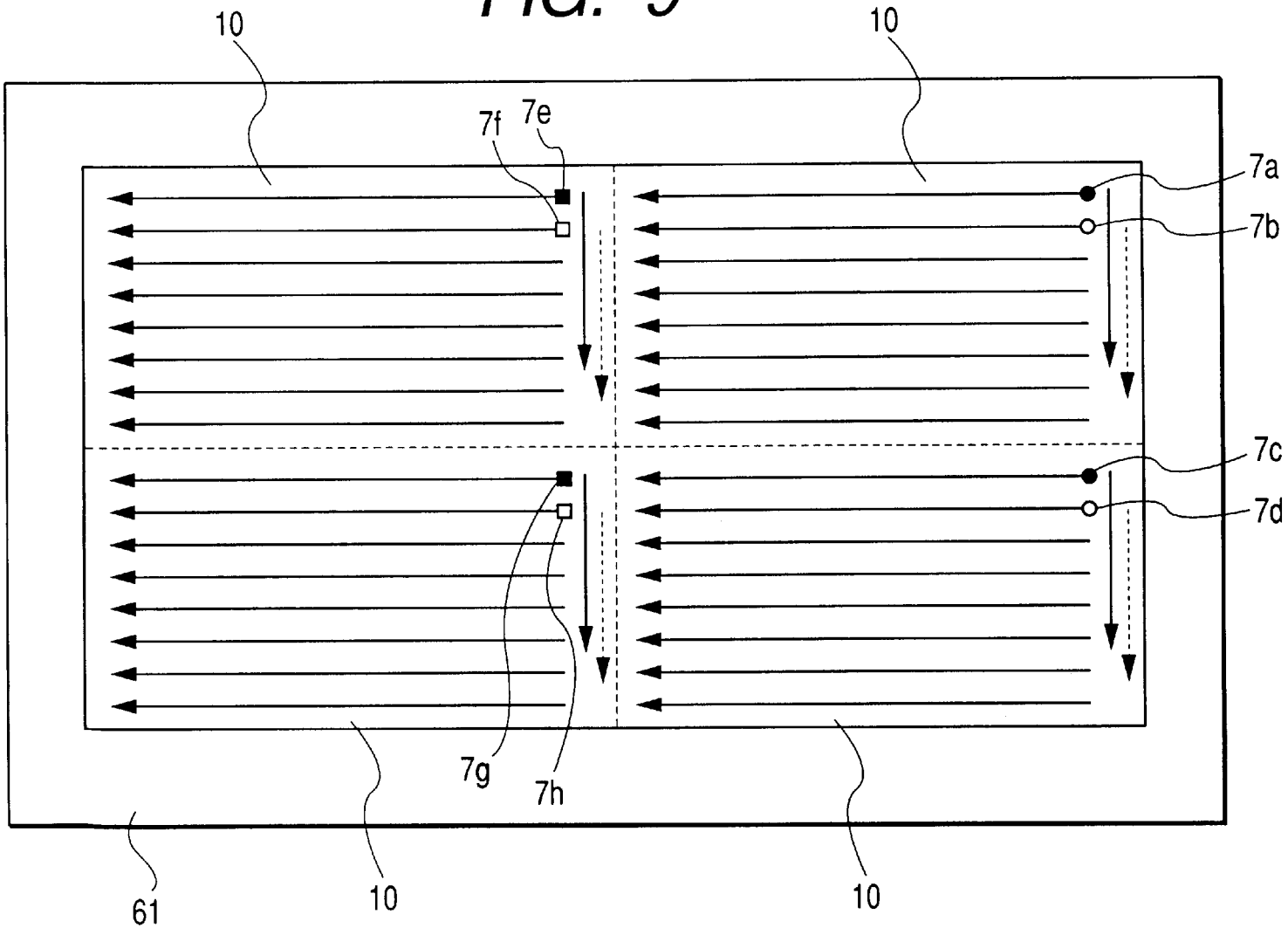
FIG. 9 is a schematic diagram to show a droplet dispensing way with plural nozzles in a third embodiment of the present invention.

In this example of production of surface conduction type electron emitting elements, the basic idea was exactly the same as in Example 1, but the number of nozzles used for dispensing of droplet was eight. The source liquid for droplet was an aqueous-solution-based liquid; specifically, an aqueous solution of palladium acetate-ethanolamine complex, which was an aqueous solution having the composition of 0.05 wt % polyvinyl alcohol, 15 wt % 2-propanol, 1 wt % ethylene glycol, and 0.15wt % palladium acetate-ethanolamine complex ($Pd(NH_2CH_2CH_2OH)_4(CH_3COO)_2$) based on the palladium concentration by weight, dissolved in water. The ink jet head was of the bubble jet method for generating a bubble in the solution by use of thermal energy and discharging the solution, based on the generation of the bubble. In the present example the electron emission area was divided into four areas of 2 vertical×2 horizontal, two nozzles being arranged per area, and the relative movement between the nozzles and the substrate in each area was carried out in the same patterns as in Example 1 (FIG. 9).

Using the eight nozzles of the ink jet device for dispensing the droplets to the electron emission area, the dispensing operations of droplets were carried out by the constant driving pulse and delivery amounts thereof were detected. On this.occasion the driving pulse was a rectangular wave. In the present example the delivery amounts from the respective nozzles were measured by the same method as in Example 2. The results of measurement of the delivery amounts from the respective nozzles were as follows; the nozzle 7*a* 50 pl; the nozzle 7*b* 48 pl; the nozzle 7*c* 52 pl; the nozzle 7*d* 50 pl; the nozzle 7*e* 50 pl; the nozzle 7*f* 50 pl; the nozzle 7*g* 50 pl; the nozzle 7*h* 49 pl. Therefore, the width of the driving pulse was adjusted for each nozzle so that the delivery amounts of the nozzles 7*b*, 7*c*, 7*h* became 50 pl. This adjustment permits the nozzles 7*b*, 7*c*, 7*h* to dispense the same amount of droplet as the other nozzles.

Four droplets were successively dispensed to a gap portion between each pair of element electrodes in superimposed manner as in Example 1. On this occasion, the dispensing intervals of droplet to each element were the same as in Example 1. After dispensing of droplet, the substrate was heated in the baking furnace at 350° C. for 20 minutes to remove the organic components, thereby forming the conductive thin film of fine particles of palladium oxide (PdO) in the element electrode portions. The conductive thin film after baked had the diameter of the circle of about 100 μm and the thickness of 150 Å. The element length was about 100 μm. Since the driving pulses were set for the respective nozzles in order.to suppress the dispersion in the delivery amounts of the eight nozzles of the ink jet device for dispensing the droplets to the electron emission area, the dispersion was small in the diameter and the thickness of the conductive thin film, irrespective of which nozzle was used for dispensing of droplet.

Further, the voltage was placed between the element electrodes 2, 3 where the conductive thin film was formed, so as to effect the electric forming process or the like on the conductive thin film to form the electron emitting portions, and to perform the activation process and the stabilization process, thus completing the electron source substrate having the surface conduction type electron emitting element group.

The large-area electron source substrate produced by the method described in Example 3 above was the one with less dispersion in the electron emission characteristics.

As detailed above, the present invention allows the droplets to be dispensed simultaneously and in parallel from the plural nozzles and thus permits a lot of droplets to be dispensed in a short time. This increases the throughput of the electron source substrate and image forming apparatus. In addition, the delivery amounts from the respective nozzles are detected preliminarily; if there is dispersion in the delivery amounts thus detected, correction will be made for driving waveforms of voltage applied to the nozzles having deviation from the desired delivery amount, thereby correcting the delivery amounts from the respective nozzles; whereby the nozzles can dispense the desired amount of liquid. The invention can also lower the dispersion in the shape and the resistance of the conductive thin film formed by dispensing of droplet. Therefore, conductive thin films are formed with equivalent characteristics, regardless of which nozzle is used to make each film by dispensing of droplet. The dispersion is suppressed in the electron emission characteristics accordingly.

The present invention thus permits the excellent electron source substrate and image forming apparatus with less dispersion in the electron emission characteristics and with less dispersion in the luminance of image to be formed readily with high throughput.

What is claimed is:

1. A method for producing an electron source having a plurality of electron emitting portions, said method comprising steps of:

outputting a material for formation of said electron emitting portions from each of plural output portions for respectively outputting the material;

detecting state of output from each output portion;

adjusting the state of output from each output portion, based on a result of the detecting step; and dispensing said material to objective portions to which said material is to be dispensed, in the state adjusted in said adjusting step.

2. The method for producing the electron source according to claim 1, wherein said state adjusted is a delivery amount from each output portion.

3. The method for producing the electron source according to claim 1, wherein the dispensing of the material from the different output portions is carried out substantially simultaneously to the different objective portions.

4. The method for producing the electron source according to claim 1, wherein the dispensing of said material is carried out while moving said output portions relative to said objective portions.

5. The method for producing the electron source according to claim 1, wherein the adjusting of the dispensing state is carried out by adjusting a driving signal for dispensing said material from each output portion.

6. The method for producing the electron source according to claim 1, wherein the dispensing of said material is dispensing of a liquid containing at least said material.

7. The method for producing the electron source according to claim 6, wherein the dispensing of said material is carried out by an ink jet method.

8. The method for producing the electron source according to claim 1, wherein the dispensing of said material is carried out by a method for generating a bubble in said material by use of thermal energy and dispensing said material, based on generation of the bubble.

9. The method for producing the electron source according to claim 1, wherein the dispensing of said material is carried out by dispensing said material by means of a piezoelectric device.

10. The method for producing the electron source according to claim 1, wherein each of said electron emitting portions is formed between element electrodes.

11. The method for producing the electron source according to claim 1, further comprising a step of forming said electron emitting portions by electrification of the material deposited on the objective portions.

12. The method for producing the electron source according to claim 1, wherein said material contains an electrically conductive material.

13. The method for producing the electron source according to claim 1, wherein the adjusting of said state is such adjustment as to equal the states from the respective output portions.

14. The method for producing the electron source according to claim 1, wherein each of said plural output portions corresponds to one of plural areas each having a plurality of said objective portions and each output portion successively dispenses said material to the plurality of objective portions in a corresponding area.

15. An apparatus for producing an electron source having a plurality of electron emitting portions, said apparatus comprising:

a plurality of output portions for respectively outputting a material for formation of said electron emitting portions;

detecting means for detecting a state from each of the plurality of output portions and outputting a detection result; and adjusting means for adjusting a state of output from each output portion, based on the detection result of said detection means.

16. The apparatus for producing the electron source according to claim 15, further comprising means for relatively moving said output portions relative to said objective portions.

* * * * *

UNITED STATES PATENT AND TRADEMARK OFFICE

CERTIFICATE OF CORRECTION

PATENT NO. : 6,210,245 B1
DATED : April 3, 2001
INVENTOR(S) : Kazuhiro Sando et al.

It is certified that error appears in the above-identified patent and that said Letters Patent is hereby corrected as shown below:

Column 6,
Line 44, "μmand" should read -- μm and --; and
Line 54, "the all" should read -- all the --.

Column 9,
Line 11, "13A;" should read -- 13A; and --.

Column 11,
Line 31, "not" should read -- (not --;
Line 32, "illustrated" should read -- illustrated) --; and
Line 36, "not illustrated" should read -- (not illustrated) --.

Column 15,
Line 45, ".In" should read -- In --.

Column 17,
Line 6, "not illustrated" should read -- (not illustrated) --; and
Line 45, "that" should read -- which --.

Column 18,
Line 8, "right upper" should read -- upper right --;
Line 32,"while" should be deleted;
Line 48, "droplet," should read -- droplets, --;
Line 52, "conductive" should read -- Conductive --; and
Line 67, "follow." should read -- follows. --.

Column 19,
Line 2, "can" should read -- that can --;
Line 3, "processing." should read -- processing, -- and "Wherein," should read -- wherein --;
Line 7, "a" should read -- an --;
Line 25, "Whole" should read -- The whole --;
Line 27, "not" should read -- (not -- and "drawings." should read -- drawings). --;
Line 30, "Electrically energization for conducting" should read -- After electrically energizing for conduction --.
Line 45, "Ie" should read -- $I_e$ --;
Line 48, "hight" should read -- height --;
Line 58, "Ie" should read -- $I_e$ --; and
Line 59, "wholy" should read -- wholly --.

UNITED STATES PATENT AND TRADEMARK OFFICE

CERTIFICATE OF CORRECTION

PATENT NO. : 6,210,245 B1
DATED : April 3, 2001
INVENTOR(S) : Kazuhiro Sando et al.

It is certified that error appears in the above-identified patent and that said Letters Patent is hereby corrected as shown below:

Column 20,
Line 3, "follows;" should read -- follows: --; and
Line 13, "results;" should read -- results: --.

Column 21,
Line 9, "follows;" should read -- follows: --;
Line 12, "nozzle" should read -- nozzles --;
Line 39, "element-electrodes" should read -- element electrodes --; and
Line 47, "baked" should read -- being baked --.

Column 22,
Line 32, "0.15 wt%" should read -- 0.15 wt % --;
Line 48, "this.occasion" should read -- this occasion --; and
Line 52, "follows;" should read -- follows: --.

Column 23,
Line 3, "baked" should read -- being baked --;
Line 6, "order.to" should read -- order to --.

Column 24,
Line 45, "portions" should read -- portions, --.

Signed and Sealed this

Twenty-sixth Day of March, 2002

*Attest:*

*Attesting Officer*

JAMES E. ROGAN
*Director of the United States Patent and Trademark Office*